US011657760B2

(12) United States Patent
Park et al.

(10) Patent No.: US 11,657,760 B2
(45) Date of Patent: May 23, 2023

(54) LIGHT EMISSION DRIVER AND DISPLAY DEVICE HAVING THE SAME

(71) Applicant: Samsung Display Co., Ltd., Yongin-si (KR)

(72) Inventors: Jun Hyun Park, Yongin-si (KR); Bon Yong Koo, Yongin-si (KR); Yu Jin Lee, Yongin-si (KR); Kyung Hoon Chung, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 226 days.

(21) Appl. No.: 16/889,606

(22) Filed: Jun. 1, 2020

(65) Prior Publication Data

US 2021/0074215 A1 Mar. 11, 2021

(30) Foreign Application Priority Data

Sep. 5, 2019 (KR) ..... 10-2019-0110141

(51) Int. Cl.

| | |
|---|---|
| ***G09G 3/3258*** | (2016.01) |
| ***G09G 3/3233*** | (2016.01) |
| ***G09G 3/3266*** | (2016.01) |
| ***G09G 3/3275*** | (2016.01) |

(52) U.S. Cl.

CPC ..... *G09G 3/3258* (2013.01); *G09G 3/3233* (2013.01); *G09G 3/3266* (2013.01); *G09G 3/3275* (2013.01); *G09G 2300/0426* (2013.01); *G09G 2310/08* (2013.01); *G09G 2320/0252* (2013.01)

(58) Field of Classification Search

CPC .. G09G 3/3258; G09G 3/3233; G09G 3/3266; G09G 3/3275; G09G 2300/0426; G09G 2310/08; G09G 2320/0252

See application file for complete search history.

(56) References Cited

U.S. PATENT DOCUMENTS

| | | | |
|---|---|---|---|
| 9,318,055 | B2 | 4/2016 | Kim et al. |
| 9,515,647 | B2 | 12/2016 | Lim et al. |
| 9,548,026 | B2 | 1/2017 | Jang |

(Continued)

FOREIGN PATENT DOCUMENTS

| | | | |
|---|---|---|---|
| KR | 10-2014-0147998 | A | 12/2014 |
| KR | 10-2015-0141263 | A | 12/2015 |

(Continued)

*Primary Examiner* — Patrick N Edouard
*Assistant Examiner* — Eboni N Giles
(74) *Attorney, Agent, or Firm* — Lewis Roca Rothgerber Christie LLP

(57) ABSTRACT

A light emission driver includes a plurality of stages outputs a light emission control signal. Each of the stages includes an input circuit controlling voltages of a first node and a second node, an output circuit supplying a voltage of first power or a second power to an output terminal, a first signal processor controlling a voltage of a fourth node based on a signal supplied to a third input terminal and a voltage of a fifth node, a second signal processor controlling the voltage of the fourth node in response to the voltage of a third node, a first stabilizer limiting voltage drops of the first node and the second node, and a second stabilizer controlling an electrical connection between the third node and the first node in response to the voltage of the fourth node.

16 Claims, 12 Drawing Sheets

(56) References Cited

U.S. PATENT DOCUMENTS

| | | | | |
|---|---|---|---|---|
| 10,311,781 | B2 | 6/2019 | Lee et al. | |
| 2010/0207968 | A1* | 8/2010 | Kim | G09G 3/3266 345/691 |
| 2015/0035733 | A1* | 2/2015 | Woo | G09G 3/3266 345/76 |
| 2017/0365211 | A1* | 12/2017 | Lee | G09G 3/3275 |
| 2019/0164498 | A1* | 5/2019 | Jang | G09G 3/32 |
| 2019/0172397 | A1* | 6/2019 | Lee | G09G 3/3266 |
| 2020/0294461 | A1* | 9/2020 | Xu | G09G 3/3677 |

FOREIGN PATENT DOCUMENTS

| | | | |
|---|---|---|---|
| KR | 10-2017-0143052 | A | 12/2017 |
| KR | 10-1975581 | B1 | 9/2019 |

* cited by examiner

LIGHT EMISSION DRIVER AND DISPLAY DEVICE HAVING THE SAME

CROSS-REFERENCE TO RELATED APPLICATION

The present application claims priority to and the benefit of Korean Patent Application No. 10-2019-0110141, filed on Sep. 5, 2019, the content of which in its entirety is herein incorporated by reference.

BACKGROUND

1. Field

Aspects of some example embodiments of the present disclosure relate to a display device.

2. Description of the Related Art

A display device generally includes a data driver for supplying a data signal to data lines, a scan driver for supplying a scan signal to scan lines, a light emission driver for supplying a light emission control signal to a light emission control line, and pixels positioned to be connected to the data lines, the scan lines, and the light emission control lines.

Here, a light emission time of the pixels may be controlled by the light emission control signal supplied from the light emission driver. To this end, the light emission driver may include a stage connected to each of the light emission control lines. The stage generates the light emission control signal according to a plurality of clock signals.

A relatively fast driving frequency for image display may be desired as a resolution increases, for stereoscopic images display, and the like. Due to the fast driving frequency, a time and a data writing time for compensating for a threshold voltage of a driving transistor of the pixel may be insufficient.

The above information disclosed in this Background section is only for enhancement of understanding of the background and therefore the information discussed in this Background section does not necessarily constitute prior art.

SUMMARY

Aspects of some example embodiments may enable securing sufficient compensation time and/or data writing time in high speed driving.

Aspects of some example embodiments of the present disclosure relate to a display device, and for example, to a light emission driver that outputs a light emission control signal and a display device including the light emission driver.

Aspects of some example embodiments of the disclosure may include a light emission driver including a stage which shortens a falling time of a light emission control signal and disconnects an electrical connection between a first node and a third node when the light emission control signal is output.

Aspects of some example embodiments of the disclosure may further include a display device including the light emission driver.

However, the characteristics of the disclosure are not limited to the above-described characteristics, and may be variously expanded within a range without departing from the spirit and scope of the disclosure.

A light emission driver according to some example embodiments of the disclosure may include a plurality of stages configured to output a light emission control signal. Each of the stages may include an input unit configured to control voltages of a first node and a second node in response to signals supplied to a first input terminal, a second input terminal, and a third input terminal, an output unit configured to supply a voltage of first power or a voltage of second power to an output terminal in response to a voltage of a third node and a voltage of a fourth node, a first signal processor connected to a fifth node electrically connecting the second node and the fourth node to each other and configured to control the voltage of the fourth node based on the signal supplied to the third input terminal and a voltage of the fifth node, a second signal processor configured to control the voltage of the fourth node in response to the voltage of the third node, a first stabilizer electrically connected between the input unit and the output unit and configured to limit a voltage drop of the first node and the second node, and a second stabilizer configured to control an electrical connection between the third node and the first node in response to the voltage of the fourth node.

According to some example embodiments, the second stabilizer may include a first transistor having a first electrode connected to the fourth node and a gate electrode connected to the third input terminal, and a second transistor connected between the first node and the third node and having a gate electrode connected to a second electrode of the first transistor.

According to some example embodiments, the second stabilizer may disconnect the electrical connection between the first node and the third node in response to the signal supplied to the third input terminal and the voltage of the fourth node, in a period in which the light emission control signal has a gate on level.

According to some example embodiments, the input unit may include a third transistor connected between the first input terminal and the first node and having a gate electrode connected to the second input terminal, a fourth transistor connected between the second input terminal and the second node and having a gate electrode connected to the first node, a fifth transistor connected between the first power and the second node and having a gate electrode connected to the second input terminal, and a sixth transistor and a seventh transistor connected in series with each other between the second power and the first node, a gate electrode of the sixth transistor may be connected to the second node, and a gate electrode of the seventh transistor may be connected to the third input terminal.

According to some example embodiments, the fourth transistor may include a plurality of sub-transistors connected in series with each other, and each of the sub-transistors may include a gate electrode commonly connected to the first node.

According to some example embodiments, the output unit may include an eighth transistor connected between the first power and the output terminal and having a gate electrode connected to the third node, a ninth transistor connected between the second power and the output terminal and having a gate electrode connected to the fourth node, and a first capacitor connected between the output terminal and the third node.

According to some example embodiments, when the second transistor is turned off in a turn-on state of the eighth transistor, the third node may maintain a voltage of a gate on level.

According to some example embodiments, the output unit may further include a second capacitor connected between the third node and the third input terminal.

According to some example embodiments, a capacitance of the first capacitor may be at least twice a capacitance of the second capacitor.

According to some example embodiments, the first signal processor may include a tenth transistor connected between the third input terminal and a sixth node and having a gate electrode connected to the sixth node, an eleventh transistor connected between the sixth node and the fourth node and having a gate electrode connected to the third input terminal, and a third capacitor connected between the fifth node and the sixth node.

According to some example embodiments, the second signal processor may include a twelfth transistor connected between the second power and the fourth node and having a gate electrode electrically connected to the third node, and a fourth capacitor connected between the second power and the fourth node.

According to some example embodiments, the first stabilizer may include a thirteenth transistor connected between the second node and the fifth node and having a gate electrode receiving the voltage of the first power, and a fourteenth transistor connected between the second transistor and the third node and having a gate electrode receiving the voltage of the first power.

According to some example embodiments, the input unit may include a third transistor connected between the first input terminal and the first node and having a gate electrode connected to the second input terminal, a fourth transistor connected between the second input terminal and the second node and having a gate electrode connected to the first node, a fifth transistor connected between the first power and the second node and having a gate electrode connected to the second input terminal, and a sixth transistor and a seventh transistor connected in series with each other between the second power and the third input terminal, a gate electrode of the sixth transistor may be connected to the second node, and a gate electrode of the seventh transistor may be connected to the third node.

According to some example embodiments, the output unit may output the light emission control signal having at least two gate off periods during one frame.

According to some example embodiments, the first input terminal may receive a start pulse or an output signal of a previous stage.

According to some example embodiments, the second input terminal may receive a first clock signal, the third input terminal may receive a second clock signal, the first clock signal and the second clock signal may have the same period, and the second clock signal may be a signal shifted by a half period from the first clock signal.

A display device according to some example embodiments of the disclosure may include a display panel including a plurality of pixels, a scan driver configured to supply a scan signal to the pixels through scan lines, a data driver configured to supply a data signal to the pixels through data lines, and a light emission driver including a plurality of stages to supply a light emission control signal to the pixels through light emission control lines. Each of the stages may include an input unit configured to control voltages of a first node and a second node in response to signals supplied to a first input terminal, a second input terminal, and a third input terminal, an output unit configured to supply a voltage of first power or a voltage of second power to an output terminal in response to a voltage of a third node and a voltage of a fourth node, a first signal processor connected to a fifth node electrically connecting the second node and the fourth node to each other and configured to control the voltage of the fourth node based on the signal supplied to the third input terminal and a voltage of the fifth node, a second signal processor configured to control the voltage of the fourth node in response to the voltage of the third node, a stabilizer electrically connected between the input unit and the output unit and configured to limit a voltage drop of the first node and the second node, and a second stabilizer configured to control an electrical connection between the third node and the first node in response to the signal supplied to the third input terminal.

According to some example embodiments, the second stabilizer may include a first transistor having a first electrode connected to the fourth node and a gate electrode connected to the third input terminal, and a second transistor connected between the first node and the third node and having a gate electrode connected to a second electrode of the first transistor.

According to some example embodiments, the output unit may include a third transistor connected between the first power and the output terminal and having a gate electrode connected to the third node, a fourth transistor connected between the second power and the output terminal and having a gate electrode connected to the fourth node, a first capacitor connected between the output terminal and the third node, and a second capacitor connected between the output terminal and the third input terminal.

According to some example embodiments, the second stabilizer may disconnect the electrical connection between the first node and the third node in response to the signal supplied to the third input terminal and the voltage of the fourth node while the light emission control signal is output.

The light emission driver and the display device having the same according to some example embodiments of the invention may include a stage having a second stabilizer that disconnects (node separation) the electrical connection between the first node and the third node in a gate on period of the light emission control signal. Therefore, instances of an unintentional increase of a voltage level of the light emission control signal (or unintentional turn-off of the eighth transistor (pull-down transistor) or an unintentional increase of a gate voltage of the eighth transistor) in the gate on period of the light emission control signal may be prevented or reduced.

In addition, because the stage included in the light emission driver includes the first and second capacitors, the falling time of the light emission control signal may be shortened without malfunction of the eighth transistor, and a falling step may be eliminated. Therefore, driving reliability in a high speed driving method of the display device may be improved.

However, the characteristics of embodiments according to the disclosure are not limited to the above-described characteristics, and may be variously expanded within a range without departing from the spirit and scope of the disclosure.

BRIEF DESCRIPTION OF THE DRAWINGS

The above and other features of the invention will become more apparent by describing in further detail embodiments thereof with reference to the accompanying drawings, in which.

DETAILED DESCRIPTION

Figure 1:
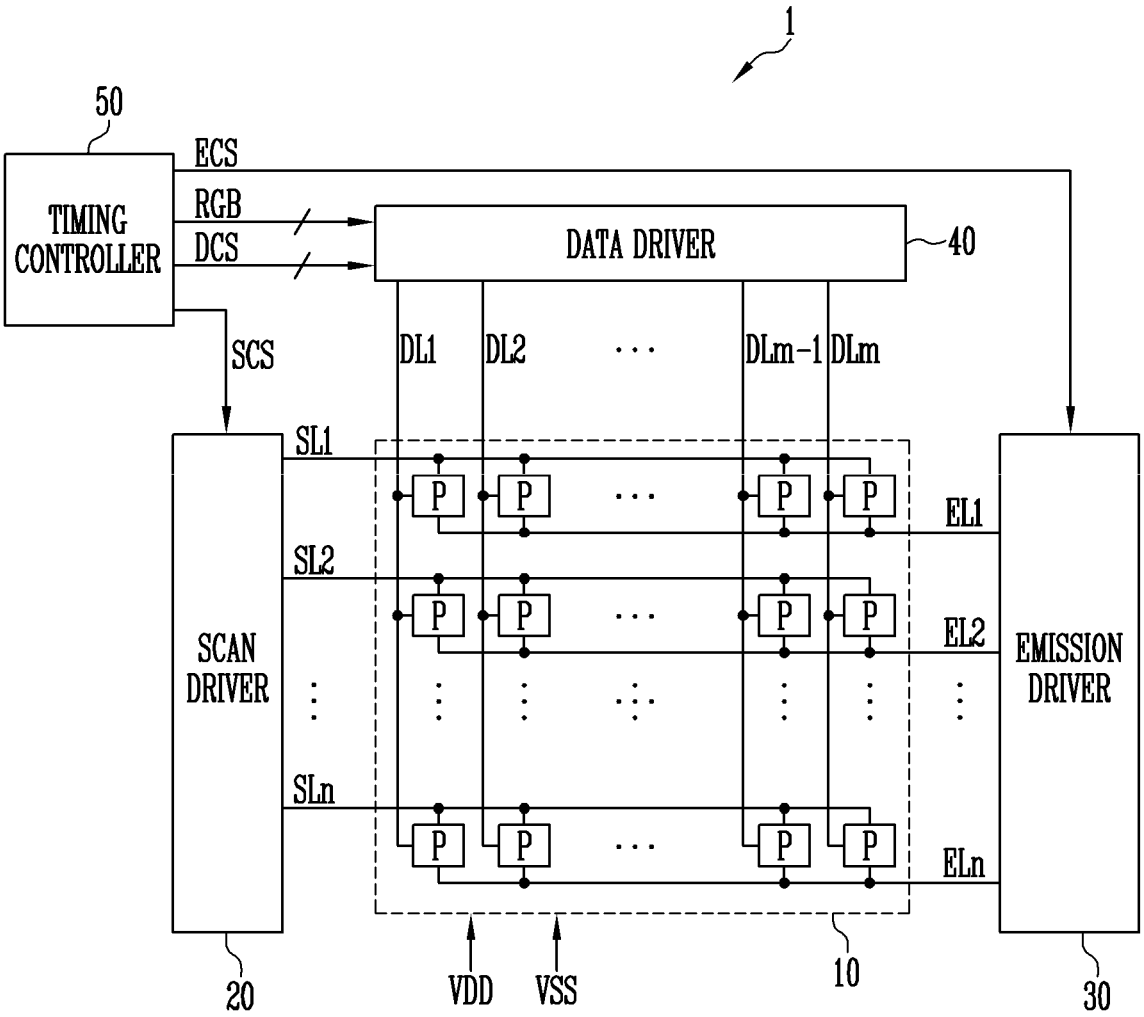
FIG. 1 is a block diagram illustrating a display device according to some example embodiments of the disclosure.

Hereinafter aspects of some example embodiments of the disclosure will be described in more detail with reference to the accompanying drawings. The same reference numerals are used for the same components in the drawings, and repetitive descriptions of the same components are omitted.

FIG. 1 is a block diagram illustrating a display device according to some example embodiments of the disclosure.

Referring to FIG. 1, the display device 1 may include a display panel 10, a scan driver 20 (or a first gate driver), a light emission driver 30 (or a second gate driver), a data driver 40, and a timing controller 50.

The display panel 10 displays an image (e.g., a static image or video images). The display panel 10 includes a plurality of scan lines SL1 to SLn, a plurality of data lines DL1 to DLm, and a plurality of light emission control lines EL1 to ELn. In addition, the display panel 10 includes a plurality of pixels P connected to the scan lines SL1 to SLn, the light emission control lines EL1 to ELn, and the data lines DL1 to DLm.

According to some example embodiments, each of the number of scan lines SL1 to SLn and light emission control lines EU to ELn may be n. The number of data lines DL1 to DLm may be m, where n and m are natural numbers (e.g., greater than zero). Therefore, the number of pixels P may be n×m. The display panel 10 may receive first driving power VDD and second driving power VSS from the outside (for example, a power supply).

The timing controller 50 may receive an input control signal and an input image signal from an image source such as an external graphic device. The timing controller 50 generates image data RGB corresponding to an operation condition of the display panel 10 based on the input image signal and provides the image data RGB to the data driver 40. The timing controller 50 may generate a first driving control signal SCS for controlling a driving timing of the scan driver 20, a second driving control signal ECS for controlling a driving timing of the light emission driver 30, and a third driving control signal DCS for controlling a driving timing of the data driver 40, based on the input control signal, and may provide the first driving control signal SCS, second driving control signal ECS, and the third driving control signal DCS to the scan driver 20, the light emission driver 30, and the data driver 40, respectively.

The first driving control signal SCS may include a scan start signal (or a scan start pulse) and clock signals. The scan start signal may control a first timing of the scan signal. The clock signals are used to shift the scan start pulse.

The second driving control signal ECS may include a light emission control start signal (or a light emission control start pulse) and clock signals. The light emission control start signal may control a first timing of the light emission control signal. The clock signals are used to shift the light emission control start pulse.

The third driving control signal DCS may include a source start pulse and clock signals. The source start pulse may control a sampling start time point of data. The clock signals are used to control a sampling operation.

The scan driver 20 may receive the first driving control signal SCS from the timing controller 50. The scan driver 20 may supply a scan signal to the scan lines SL1 to SLn in response to the first driving control signal SCS.

The light emission driver 30 may receive the second driving control signal ECS from the timing controller 50. The light emission driver 30 supplies a light emission control signal to the light emission control lines EL1 to ELn in response to the second driving control signal ECS. The light emission control signal may control a light emission time of the pixels P.

The data driver 40 may receive the third driving control signal DCS from the timing controller 50. The data driver 40 may supply a data signal (data voltage) of an analog format to the data lines DL1 to DLm in response to the third driving control signal DCS. The data signal supplied to the data lines DL1 to DLm is supplied to the pixels P selected by the scan signal.

Figure 2A:
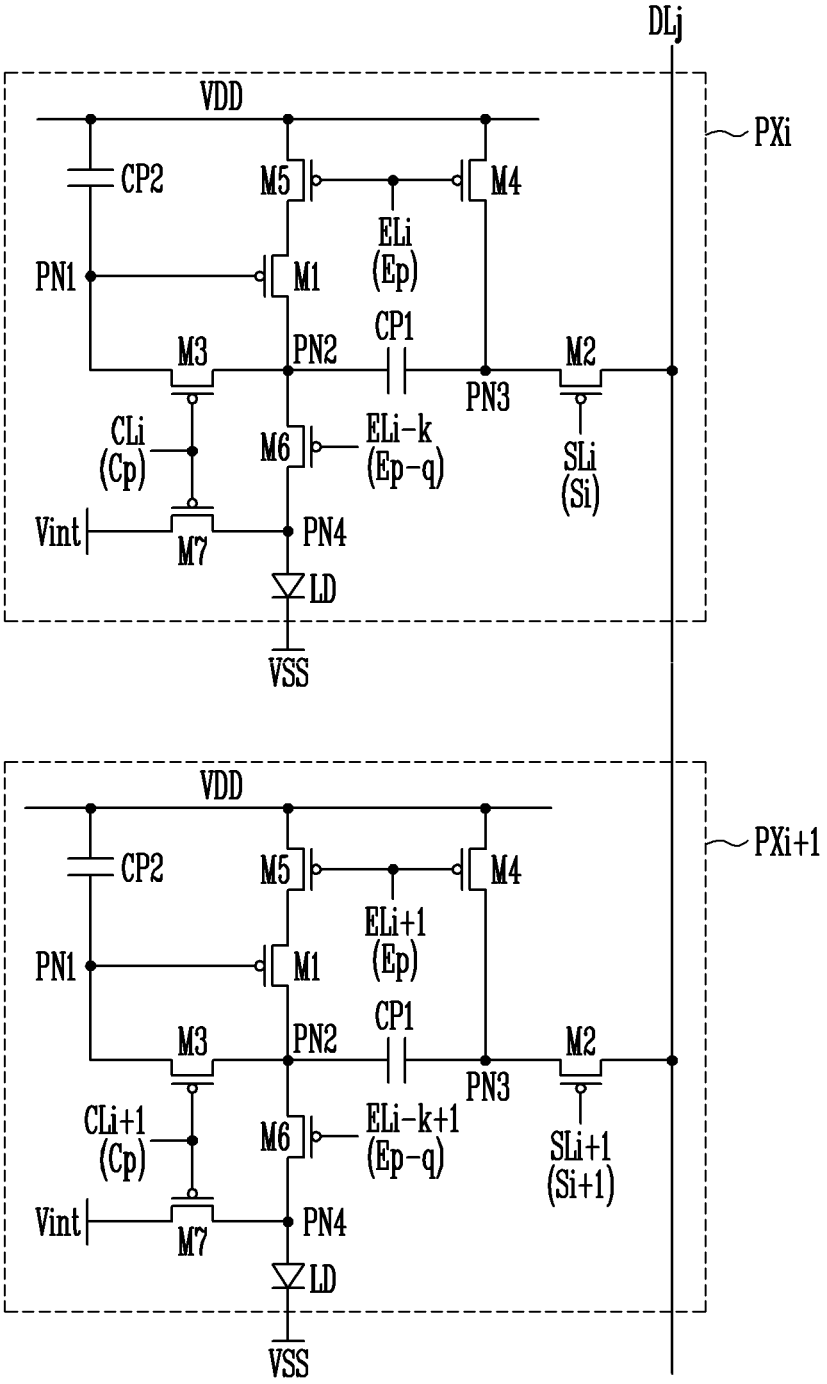
FIG. 2A is a circuit diagram illustrating an example of pixels included in the display device of FIG. 1.
Figure 2B:
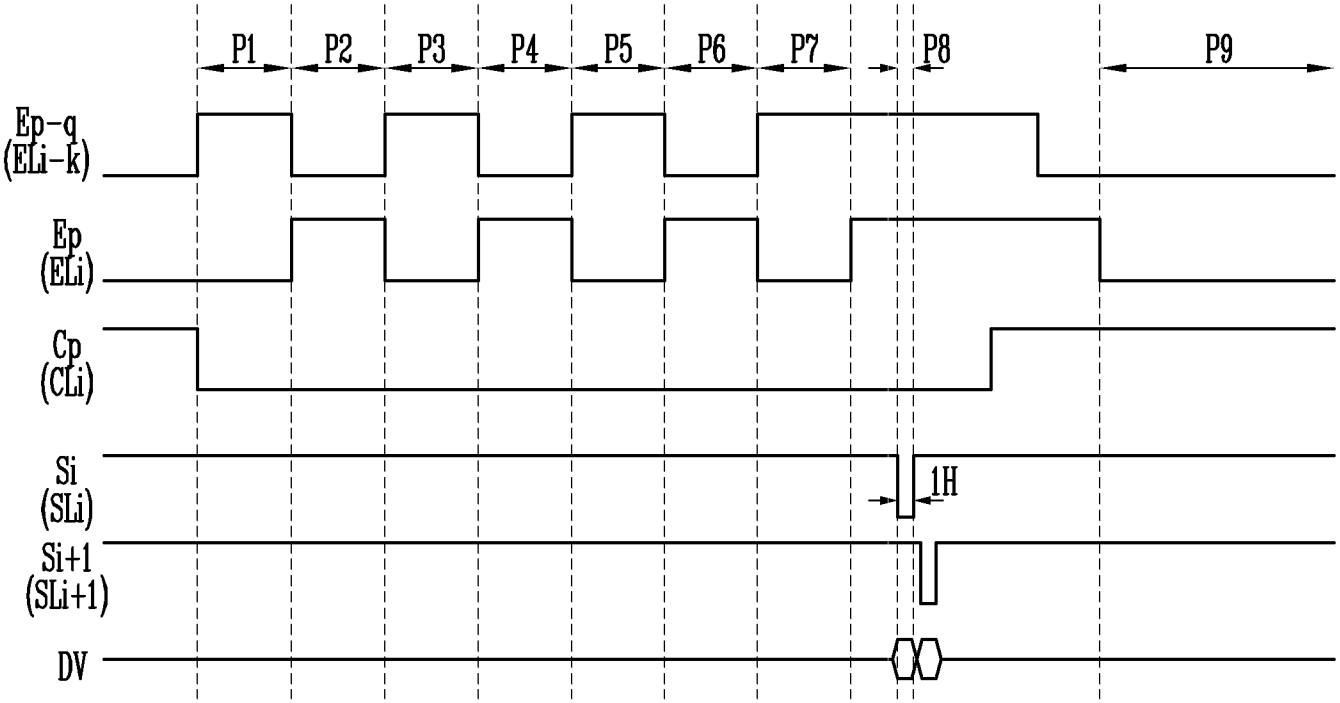
FIG. 2B is a circuit diagram for describing signals supplied to the pixels of FIG. 2A.

FIG. 2A is a circuit diagram illustrating an example of the pixels included in the display device of FIG. 1, and FIG. 2B is a circuit diagram for describing signals supplied to the pixels of FIG. 2A.

For convenience of description, FIGS. 2A, and 2B shows a pixel PXi positioned in an i-th horizontal line (or an i-th pixel row) and connected to a j-th data line DLj, and a pixel PXi+1 positioned in an (i+1)-th horizontal line (or an (i+1)-th pixel row) and connected to the j-th data line DLj (where i and j are natural numbers (e.g., greater than zero)).

Referring to FIGS. 2A and 2B, each of the pixels PXi and PXi+1 may include a light emitting element LD, first to seventh transistors M1 to M7, a first pixel capacitor CP1, and a second pixel capacitor CP2. Some example embodiments may include additional transistors and capacitors, or fewer transistors and capacitors, without departing from the spirit and scope of embodiments according to the present disclosure.

According to some example embodiments, all of the first to seventh transistors M1 to M7 may be transistors of the same type. For example, the first to seventh transistors M1 to M7 may be P-channel metal oxide semiconductor (PMOS) transistors. The first to seventh transistors M1 to M7 may include an active layer formed of a polysilicon semiconductor. For example, the active layers of the first to seventh transistors M1 to M7 may be formed through a low temperature poly-silicon (LTPS) process. However, this is an example, and according to some example embodiments, at least one of the first to seventh transistors M1 to M7 (or all of the first to seventh transistors M1 to M7) may be an N-channel metal oxide semiconductor (NMOS) transistor. For example, the NMOS transistor may include an active layer formed of an oxide semiconductor.

Hereinafter, for convenience of description, a pixel configuration and an operation will be described with reference to the pixel PXi of the i-th horizontal line.

A first electrode of the light emitting element LD may be electrically connected to a second electrode (for example, a drain electrode) of the first transistor M1, and a second electrode of the light emitting element LD may be connected to the second driving power VSS. For example, the first electrode of the light emitting element LD may be connected to a fourth pixel node PN4 to which one electrode of the sixth transistor M6 and one electrode of the seventh transistor M7 are commonly connected.

The light emitting element LD may generate light of a luminance (e.g., a set or predetermined luminance) according to a current amount (driving current) supplied from the first transistor T1. According to some example embodiments, the light emitting element LD may be an organic light emitting diode including an organic light emitting layer.

According to some example embodiments, the light emitting element LD may be an inorganic light emitting element formed of an inorganic material. Alternatively, the light emitting element LD may have a form in which a plurality of inorganic light emitting elements are connected in parallel and/or in series between the second driving power VSS and the second electrode of the first transistor M1.

The first transistor M1 may be electrically coupled between the first driving power VDD and the first electrode of the light emitting element LD. The first transistor M1 may generate the driving current and provide the driving current to the light emitting element LD. A gate electrode of the first transistor M1 may be coupled to a first pixel node PN1. The first transistor M1 functions as a driving transistor.

The first pixel capacitor CP1 may be coupled between a second pixel node PN2 corresponding to the second electrode of the first transistor M1, and a third pixel node PN3. The first pixel capacitor CP1 may store a voltage difference between the second pixel node PN2 and the third pixel node PN3.

The second pixel capacitor CP2 may be coupled between the first driving power VDD and the first pixel node PN1. The second pixel capacitor CP2 may store a voltage difference between the first driving power VDD and the first pixel node PN1.

Meanwhile, when the data signal of the pixel is written, the first pixel node PN1 and the second pixel node PN2 may have a voltage corresponding to a ratio of capacitances of the first pixel capacitor CP1 and the second pixel capacitor CP2 by charge sharing between the first pixel capacitor CP1 and the second pixel capacitor CP2.

The second transistor M2 may be coupled between the data line DLj and the third pixel node PN3. The second transistor M2 may include a gate electrode that receives the scan signal. For example, the gate electrode of the second transistor M2 may be connected to the scan line SLi (that is, the i-th scan line). The second transistor T2 may be turned on when the scan signal is supplied to the scan line SLi, to electrically connect the data line DLj and the third node N3 to each other.

The third transistor M3 may be coupled between the first pixel node PN1 corresponding to the gate electrode of the first transistor M1, and the second pixel node PN2 (for example, the drain electrode of the first transistor M1). The third transistor M3 may include a gate electrode that receives a first control signal.

The fourth transistor M4 may be coupled between the first driving power VDD and the third pixel node PN3. The fourth transistor M4 may include a gate electrode that receives the light emission control signal.

The fifth transistor M5 may be coupled between the first driving power VDD and the first electrode of the first transistor M1. The fifth transistor M5 may include a gate electrode that receives the light emission control signal. For example, the gate electrode of the fifth transistor M5 may be connected to the light emission control line ELi.

The sixth transistor M6 may be coupled between the second pixel node PN2 corresponding to the second electrode of the first transistor M1 and the light emitting element LD. The sixth transistor M6 may include a gate electrode that receives a previous light emission control signal. For example, the gate electrode of the sixth transistor M6 may be connected to a previous light emission control line ELi−k (for example, an (i−k)-th light emission control line).

When all of the fifth and sixth transistors M5 and M6 are turned on, the light emitting element LD may emit light at a luminance corresponding to a voltage of the first pixel node PN1. According to some example embodiments, when the fifth transistor M5 is turned on and the sixth transistor M6 is turned off, a threshold voltage compensation of the first transistor M1 may be performed or an on-bias may be applied to the first transistor M1.

The seventh transistor M7 may be coupled between the light emitting element LD and initialization power Vint. The seventh transistor M7 may include a gate electrode that receives a control signal. According to some example embodiments, the gate electrode of the seventh transistor M7 may be connected to a control line CLi.

Meanwhile, a period in which the second transistor M2 is turned on and a period in which the fourth and fifth transistors M4 and M5 are turned on do not overlap. For example, when the third to fifth transistors M3 to M5 are turned on, the threshold voltage compensation of the first transistor M1 may be performed, and when the second and third transistors M2 and M3 are turned on, data writing may be performed. Therefore, a threshold voltage compensation period and a data writing period may be separated from each other. That is, according to some example embodiments, the threshold voltage compensation period and the data writing period may not overlap with one another.

Meanwhile, according to some example embodiments, the i-th pixel PXi and the (i+1)-th pixel PXi+1 may have substantially the same (or similar) pixel structure.

An i-th scan signal Si may be supplied to the i-th scan line SLi, and an (i+1)-th scan signal Si+1 may be supplied to the (i+1)-th scan line SLi+1. The (i+1)-th scan signal Si+1 may be a scan signal in which the i-th scan signal Si is shifted (delayed) by one horizontal period (1H).

A p-th (where p is a natural number) light emission control signal Ep may be commonly supplied to the i-th light emission control line ELi and the (i+1)-th light emission control line ELi+1. That is, the i-th pixel PXi and the (i+1)-th pixel may be commonly controlled by the same light emission control signal Ep. Therefore, the number of light emission control signals may be smaller than the number of scan signals supplied to the display panel during one frame period.

For example, when one light emission control signal is commonly supplied to two light emission control lines, the number of light emission control signals may be half of the number of scan signal.

According to some example embodiments, the p-th light emission control signal Ep may be a light emission control signal in which a (p−1)-th light emission control signal Ep−1 is shifted (delayed) by two horizontal periods (2H) or more.

Similarly, a (p−q)-th light emission control signal Ep-q may be commonly supplied to an (i−k)-t light emission control line ELi−k and an (i−k+1)-th light emission control line ELi−k+1. In addition, the p-th light emission control signal Ep may be a light emission control signal in which the (p−q)-th light emission control signal Ep−q is shifted by q*2 horizontal periods (2qH) or more.

A p-th control signal Cp may be commonly supplied to the i-th control line CLi and the (i+1)-th control line CLi+1. That is, the i-th pixel PXi and the (i+1)-th pixel PXi+1 may be commonly controlled by the same control signal Cp.

For example, when one light emission control signal is commonly supplied to two light emission control lines, the number of light emission control signals may be half of the number of scan signal.

According to some example embodiments, the p-th control signal Cp may be a light emission control signal in which a (p−1)-th control signal Cp−1 is shifted (delayed) by two horizontal periods (2H) or more.

In other words, the scan line may be controlled for each pixel row, and the light emission control line and the control line may be commonly controlled for each preset consecutive pixel row. Therefore, a high speed driving of the display device 1 having a driving frequency exceeding 60 Hz may be relatively easily implemented.

Hereinafter, for convenience of description, the i-th light emission control line Eli may be referred to as the light emission control line ELi, the p-th light emission control signal Ep may be referred to as the light emission control signal Ep, the i-th scan line SLi may be referred to as the scan line SLi, the i-th control line CLi may be referred to as the control line CLi, and the p-th control signal Cp may be referred to as the control signal Cp.

In addition, the light emission control signal Ep, the previous light emission control signal Ep−q, and the control signal Cp may be commonly supplied to the i-th pixel PXi and the (i+1)-th pixel PXi+1.

According to some example embodiments, the light emission control signal Ep may be a scan signal in which the previous light emission control signal Ep−q is shifted by about 6 horizontal periods (6H). In addition, the previous light emission control signal Ep−q may be the same as a light emission control signal supplied to an (i−6)-th pixel row (that is, an (i−6)-th light emission control line ELi−6).

As shown in FIG. 2B, the light emission control signal Ep may have a plurality of gate off periods (that is, periods having a logic high voltage) within one frame period.

A gate on level of the scan signal Sn, the control signal Cp, and the light emission control signals Ep and Ep−q may be a low voltage.

During a first period P1, the light emission control signal Ep may have a gate on level, and the previous light emission control signal Ep−q may have a gate off level. Therefore, light emission of the pixels PXi and PXi+1 may be stopped.

In addition, the control signal Cp has a gate on level during the first period P1. In this case, the third and seventh transistors M3 and M7 may be turned on to initialize an anode voltage of the light emitting element LD.

However, this is an example, and the control signal Cp may have a gate off level in the first period P1.

During a second period P2, the light emission control signal Ep may have a gate off level, and the previous light emission control signal Ep−q and the control signal Cp may have a gate on level. In the second period P2, a gate voltage and a drain voltage of the first transistor M1 (for example, a voltage of the second pixel node PN2) may correspond to a voltage of the initialization power Vint.

In addition, because the fifth transistor M5 is turned off in the second period P2, a source electrode of the first transistor M1 may have a voltage corresponding to a sum of the voltage of the initialization power Vint and the threshold voltage of the first transistor M1. Therefore, in the second period P2, the first transistor M1 may have an off-bias state. Therefore, an initialization period may also be understood as an off-bias period for the first transistor M1.

During a third period P3, the light emission control signal Ep may have a gate on level, and the previous light emission control signal Ep−q may have a gate off level. Therefore, the fourth and fifth transistors M4 and M5 may be turned on and the sixth transistor M6 may be turned off. Because the third transistor M3 is turned on, the first transistor M1 may have a diode connection form. A voltage corresponding to the threshold voltage Vth of the first transistor M1 may be stored in the second pixel capacitor CP2. That is, the third period P3 may be a threshold voltage compensation period.

Meanwhile, in the third period P3, the threshold voltage compensation may be performed by a voltage of the first driving power VDD which is a constant voltage source. Therefore, a threshold voltage compensation operation may be performed based on a fixed voltage rather than a data signal (data voltage) that may be changed according to the pixel row and/or the frame.

Operations of the fourth period P4 and the sixth period P6 may be substantially the same as an operation of the second period P2.

Operations of the fifth period P5 and the seventh period P7 may be substantially the same as an operation of the third period P3.

As described above, the light emission control signal Ep may have a gate on level in the first, third, fifth, and seventh periods P1, P3, P5, and P7, and may have a gate off level in the second, fourth, and sixth periods P2, P4, and P6. In the first to seventh periods P1 to P7, the previous light emission control signal Ep−q may be supplied to the pixels PXi and PXi+1 with a waveform opposite to that of the light emission control signal Ep. Therefore, the threshold voltage compensation period and the initialization period (for example, a second initialization period) may be alternately repeated a plurality of times. Thus, a compensation deviation of the threshold voltage of the first transistor M1 according to a magnitude of the data signal in the previous frame may be eliminated. In addition, because the off-bias is periodically applied to the first transistor M1, a hysteresis characteristic of the first transistor M1 may be improved.

When the scan signal Si transits from a gate off level to a gate on level, the second transistor T2 may be turned on. Therefore, a data signal DV may be supplied to the third node N3. During the eighth period P8, the scan signal Si may be supplied to the i-th pixel PXi and thus the data signal DV may be written to the i-th pixel PXi.

That is, the eighth period P8 may be a data writing period.

According to some example embodiments, the eighth period P8, that is, a length (pulse width) of the scan signal Si may be one horizontal period 1H. In addition, the (i+1)-th scan signal Si+1 may be sequentially supplied to the (i+1)-th scan line SLi+1, and data writing may be performed on the (i+1)-th pixel PXi+1 in response to the (i+1)-th scan signal Si+1.

However, this is an example, and a larger number of scan signals may be supplied during a period in which both of the previous light emission control signal Ep−q and the light emission control signal Ep have a gate off level. In this case, three or more pixel rows may be commonly (or collectively) controlled by one light emission control signal Ep and one control signal Cp.

Thereafter, the control signal Cp may be transited to a gate off level, and the previous light emission control signal Ep−q may be transited to a gate on level. Therefore, the sixth transistor M6 may be turned on, and the third and seventh transistors M3 and M7 may be turned off.

According to some example embodiments, the first to eighth periods P1 to P8 may be included in a non-light emission period of the pixel (for example, PXi and PXi+1) during one frame period.

Thereafter, a ninth period P9 in which both of the light emission control signal Ep and the previous light emission control signal Ep−q have a gate-on level may be a light emission period of the pixels PXi and PXi+1.

When the display device 1 is driven under a high driving frequency condition (for example, a frequency of 80 Hz or more), securing a time for compensating for the threshold voltage of the driving transistor included in the pixel and a data writing time is important. Therefore, as shown in FIG. 2B, a gate on period and a gate off period of the light emission control signal Ep may be quickly repeated within one frame period.

Meanwhile, the light emission control signal output from a stage included in the existing light emission driver includes a delay period (e.g., a set or predetermined delay period) in a falling time during which the light emission control signal transits from a logic high level (gate off level) to a logic low level (gate off level). That is, the light emission control signal Ep may not be quickly lowered from the logic high level (gate off level) to the logic low level (gate off level) due to an influence of the clock signals supplied to the light emission driver, and a waveform having a falling step is output.

This delay of the falling time of the light emission control signal provided to the pixels PXi and PXi+1 causes inaccurate turn-on and turn-off operations of the transistors in the pixel. Therefore, the data writing time and/or the threshold voltage compensation time of the pixel may be reduced, and image quality may be degraded. Thus, a stage configuration of a light emission driver for implementing a light emission control signal that falls quickly may be desired.

In addition, when the gate on period and the gate off period of the light emission control signal Ep are repeated, a signal output by current leakage of the transistor (for example, a pull-down transistor) may have an unintended voltage level in the gate on period. Therefore, driving for maintaining a gate-source voltage of a high level pull-down transistor in the gate on period of the light emission control signal Ep may be desired.

Figure 3A:
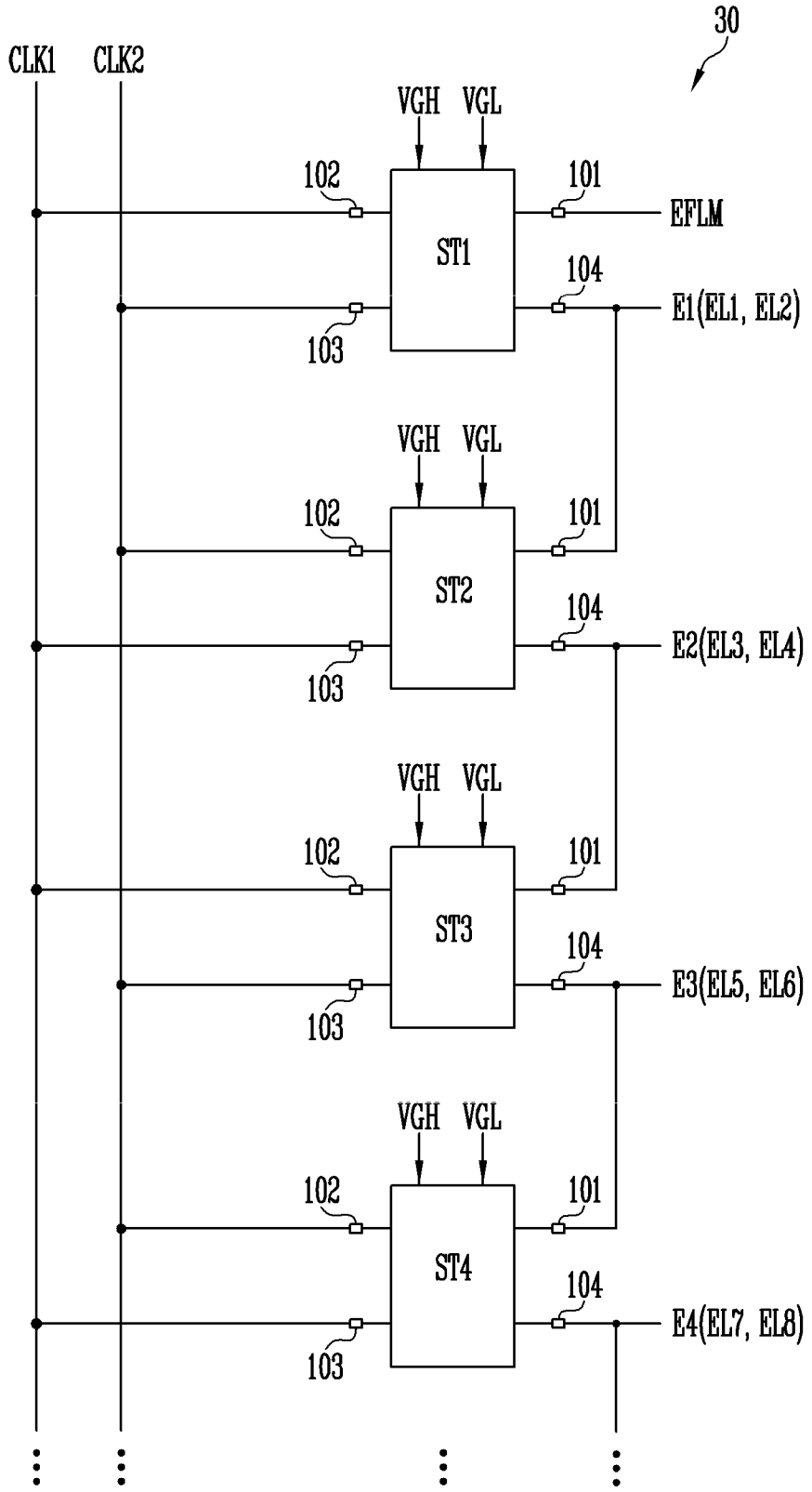
FIG. 3A is a block diagram illustrating a light emission driver according to some example embodiments of the disclosure.
Figure 3B:
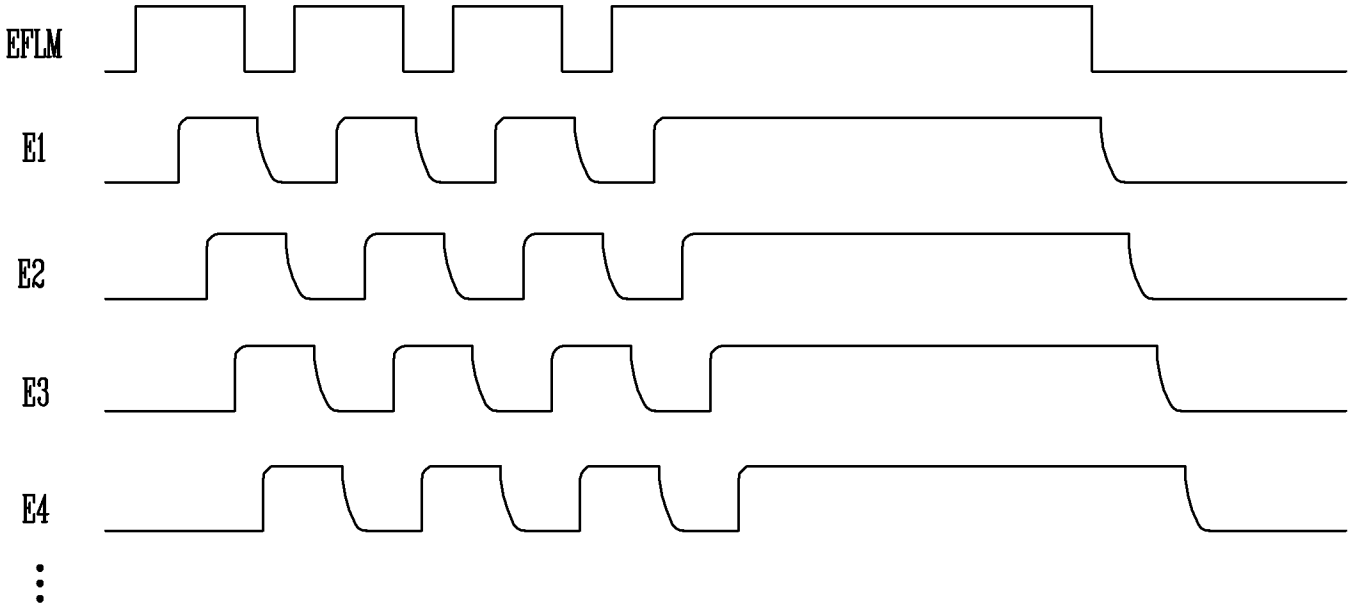
FIG. 3B is a waveform diagram illustrating an example of light emission control signals output from the light emission driver of FIG. 3A.

FIG. 3A is a block diagram illustrating the light emission driver according to some example embodiments of the disclosure, and FIG. 3B is a waveform diagram illustrating an example of the light emission control signals output from the light emission driver of FIG. 3A.

For convenience of description, FIGS. 3A and 3B show four stages and light emission control signals outputted from the four stages.

Referring to FIGS. 1, 3A, and 3B, the light emission driver 30 may include a plurality of stages ST1 to ST4. For example, the first to fourth stages ST1 to ST4 may be connected to the light emission control lines (e.g., the set or predetermined light emission control lines) respectively, and may output light emission control signals E1 to E4 in correspondence with or according to clock signals CLK1 and CLK2. The stages ST1 to ST4 may be implemented with substantially the same circuit.

According to some example embodiments, each of the first to fourth stages ST1 to ST4 may be connected to at least one light emission control line. For example, the first stage ST1 may be connected to first and second light emission control lines EL1 and EL2 and may supply a first emission control signal E1 to the first and second light emission control lines EL1 and EL2. However, this is an example, and a connection relationship between the stages ST1 to ST4 and the light emission control lines may be variously set according to the pixel structure and the driving method of the display device 1.

Each of the stages ST1 to ST4 may include a first input terminal 101, a second input terminal 102, a third input terminal 103, and an output terminal 104.

The first input terminal 101 may receive an output signal (that is, a light emission control signal) of a previous stage or a start signal EFLM. Thus, the first input terminal 101 of the first stage ST1 may be configured to receive a start signal EFLM, and the input terminal 101 of each subsequent stage may be connected to the output terminal 104 of the immediately previous stage and receive the light emission control signal output at the output terminal 104 of the previous stage. For example, the first input terminal 101 of the first stage ST1 may receive the start signal EFLM, and the first input terminal 101 of the second stage ST2 may receive the light emission control signal (for example, the first light emission control signal E1) output from the first stage ST1.

According to some example embodiments, the second input terminal 102 of a j-th (where j is a natural number less than n) stage may receive a first clock signal CLK1 and the third input terminal 103 may receive a second clock signal CLK2. Meanwhile, the second input terminal 102 of the (j+1)-th stage may receive the second clock signal CLK2, and the third input terminal 103 may receive the first clock signal CLK1.

The first clock signal CLK1 and the second clock signal CLK2 have the same period and do not overlap phases. For example, the second clock signal CLK2 may be set as a signal shifted by about half a period from the first clock signal CLK1.

In addition, the stages ST1 to ST4 receive a voltage of first power (or a first power source) VGL and a voltage of second power (or a second power source) VGH. The voltage of the first power VGL and the voltage of the second power VGH may have a DC voltage level. The voltage of the second power VGH may be set greater than the voltage of the first power VGL.

The voltage of the first power VGL may be set to a gate on level, and the voltage of the second power VGH may be set to a gate off level. For example, when the pixel P and the light emission driver 30 are formed of P-channel metal oxide semiconductor (PMOS) transistors, the voltage of the first power VGL (that is, a gate on level) may correspond to a logic low level, the voltage of the second power VGH (that is, a gate off level) may correspond to a logic high level. However, this is an example, and the first power VGL and the second power VGH are not limited thereto. For example, the voltage of the first power VGL and the voltage of the second power VGH may be set according to a type of the transistor, a use environment of the display device, and the like.

As shown in FIG. 3B, the first to fourth stages ST1 to ST4 may output the first to fourth light emission control signals E1 to E4, respectively. According to some example embodiments, within one frame period, the start signal EFLM may include a plurality of gate on periods and a plurality of gate off periods. The first stage ST1 may output the first light emission control signal E1 having a plurality of gate on periods and a plurality of gate off periods during one frame period in response to the start signal EFLM. The second stage ST2 may output the second light emission control signal E2 in which the first light emission control signal E1 is shifted by a horizontal period (e.g., a set or predetermined horizontal period) in response to the first light emission control signal E1. Similarly, the third and fourth stages ST3 and ST4 may output the third and fourth light emission control signals E3 and E4, which are shifted from the first light emission control signal E1, respectively.

Figure 4:
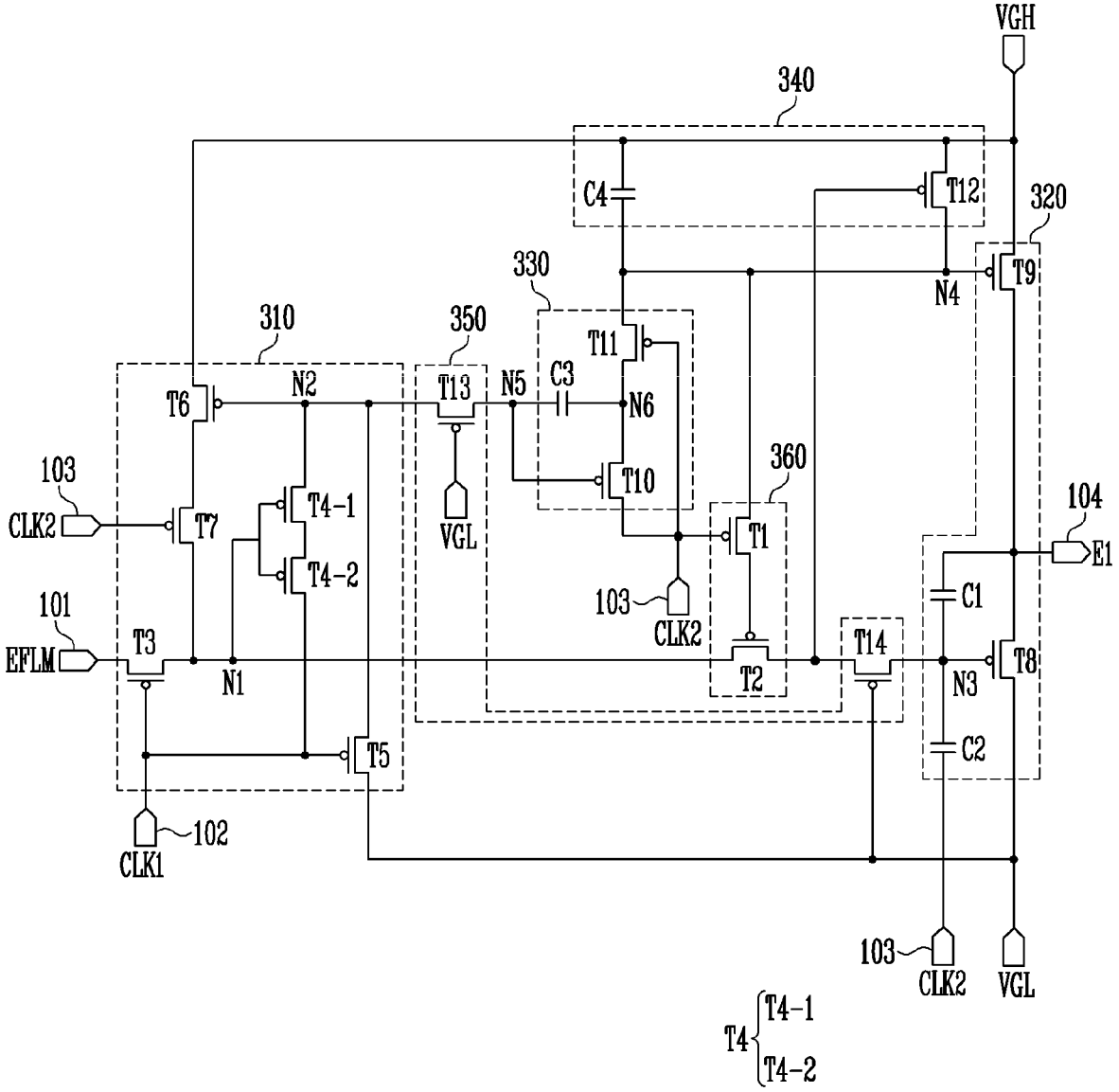
FIG. 4 is a circuit diagram illustrating an example of a stage included in the light emission driver of FIG. 3A.

FIG. 4 is a circuit diagram illustrating an example of the stage included in the light emission driver of FIG. 3A.

Referring to FIGS. 3A and 4, the first stage ST1 may include an input unit (or input circuit or input component) 310, an output unit (or output circuit or output component) 320, a first signal processor 330, a second signal processor 340, a first stabilizer 350, and a second stabilizer 360.

In FIG. 4, The stage will be descried with reference to FIG. 4 based on the first stage ST1 (that is, an odd-numbered stage) in which the first clock signal CLK1 is supplied to the second input terminal 102 and the second clock signal CLK2 is supplied to the third input terminal 103. However, this is an example, and in an even-numbered stage, the second clock signal CLK2 may be supplied to the second input terminal 102 and the first clock signal CLK1 may be supplied to the third input terminal 103.

The input unit 310 may control voltages of the first node N1 and the second node N2 in response to signals (for example, the start signal EFLM, the first clock signal CLK1, and the second clock signal CLK2) supplied to the first input terminal 101, the second input terminal 102, and the third input terminal 103. According to some example embodiments, the input unit 310 may include third to seventh transistors T3 to T7.

The third transistor T3 may be connected between the first input terminal 101 and the first node N1. The third transistor T3 may include a gate electrode connected to the second input terminal 102. The third transistor T3 may be turned on when the first clock signal CLK1 has a gate on level, to electrically connect the first input terminal 101 and the first node N1 to each other.

The fourth transistor T4 may be connected between the second input terminal 102 and the second node N2. The fourth transistor T4 may include a gate electrode connected to the first node N1. The fourth transistor T4 may be turned on or off based on the voltage of the first node N1.

According to some example embodiments, the fourth transistor T4 may include a plurality of sub-transistors T4-1 and T4-2 connected in series with each other. Each of the sub-transistors T4-1 and T4-2 may include a gate electrode commonly connected to the first node N1. Therefore, current leakage by the fourth transistor T4 may be minimized.

The fifth transistor T5 may be connected between the first power VGL and the second node N2. A gate electrode of the fifth transistor T5 may be connected to the second input terminal 102. The fifth transistor T5 may be turned on when the first clock signal CLK1 is supplied to the second input terminal 102, to supply a voltage of the first power VGL to the second node N2.

The sixth transistor T6 and the seventh transistor T7 may be connected in series with each other between the second power VGH and the first node N1. The sixth transistor T6 may include a gate electrode connected to the second node N2. The sixth transistor T6 may be turned on or off in response to a voltage of the second node N2. The seventh transistor T7 may include a gate electrode connected to the third input terminal 103. The seventh transistor T7 may be turned on in response to a gate on level of the second clock signal CLK2.

For example, when the voltage of the second node N2 has a gate on level, the seventh transistor T7 may maintain or convert the voltage of the first node N1 into a voltage of the second power VGH (that is, a gate off level) in response to the second clock signal CLK2.

The output unit 320 may supply the voltage of the first power VGL or the voltage of the second power VGH to the output terminal 104 in response to a voltage of the third node N3 and a voltage of the fourth node N4. The voltage of the first power VGL may correspond to a gate on voltage level of the first light emission control signal E1 (hereinafter referred to as a light emission control signal), and the voltage of the second power VGH may correspond to a gate off voltage level of the light emission control signal E1. However, this is an example, and the voltage of the first power VGL may correspond to the gate off voltage level of the light emission control signal E1, and the voltage of the second power VGH may correspond to the gate on voltage level of the light emission control signal E1.

According to some example embodiments, the output unit 320 may include an eighth transistor T8, a ninth transistor T9, and a first capacitor C1.

The eighth transistor T8 may be connected between the first power VGL and the output terminal 104. A gate electrode of the eighth transistor T8 may be connected to the third node N3. The eighth transistor T8 may be turned on or off in response to the voltage of the third node N3. Here, when the eighth transistor T8 is turned on, the first light emission control signal E1 supplied to the output terminal 104 has a gate on voltage (or a gate on level), and the pixel P may emit light.

The ninth transistor T9 may be connected between the second power VGH and the output terminal 104. A gate electrode of the ninth transistor T9 may be connected to the fourth node N4. The ninth transistor T9 may be turned on or off in response to the voltage of the fourth node N4. Here, when the ninth transistor T9 is turned on, the first light emission control signal E1 supplied to the output terminal 104 has a gate off level, and the pixel P has a non-light emission state.

The first capacitor C1 may be connected between the output terminal 104 and the third node N3. The first capacitor C1 may charge a voltage corresponding to the turn-on and turn-off of the eighth transistor T8. According to some example embodiments, when the second transistor T2 is turned off (that is, when an electrical connection between the first node N1 and the third node is disconnected), the eighth transistor T8 may maintain the turn-on state in correspondence with the voltage stored in the first capacitor C1. That is, the third node N3 may maintain a gate on level (for example, a logic low level) by the voltage stored in the first capacitor C1.

The first capacitor C1 may improve a falling speed of the light emission control signal E1. That is, when the light emission control signal E1 is transited from the gate off level to the gate on level, the light emission control signal E1 may be quickly transited from the gate off level to the gate on level by coupling of the first capacitor C1 by a voltage of the output terminal 104, and the falling time may be reduced.

According to some example embodiments, the output unit 320 may further include a second capacitor C2. The second capacitor C2 may be connected between the third node N3 and the third input terminal 103. The second capacitor C2 may control the voltage of the third node N3 in correspondence with the second clock signal CLK2 supplied to the third input terminal 103.

The voltage of the third node N3 (that is, a gate voltage of the eighth transistor T8) may further decrease by coupling of the first and second capacitors C1 and C2. Therefore, when the eighth transistor T8 is turned on, a gate-source voltage Vgs of the eighth transistor T8 is increased and leakage of the light emission control signal E1 may be minimized.

The second capacitor C2 may also charge a voltage applied to the third node N3. For example, a magnitude of the voltage charged in the second capacitor C2 may be changed according to a capacitance ratio of the second capacitor C2 and the first capacitor C1.

According to some example embodiments, a capacitance of the first capacitor C1 may be designed to be larger than a capacitance of the second capacitor C2. For example, as the capacitance of the first capacitor C1 is larger than the capacitance of the second capacitor C2, the falling time of the light emission control signal E1 may be shortened (that is, a slew rate is increased). Ideally, when there is no second capacitor C2, the falling time of the light emission control signal E1 may be shortest. However, a margin considering deviation on a manufacturing process and a characteristic change due to deterioration of the transistors (for example, the eighth transistor T8) is required to be set.

Therefore, the ratio of the second capacitor C2 and the first capacitor C1 may be determined in consideration of both the falling time of the light emission control signal E1 and characteristic deviation of the transistor (for example, the eighth transistor T8). According to some example embodiments, the capacitance of the first capacitor C1 may be at least twice the capacitance of the second capacitor C2. For example, the ratio of the capacitance of the first capacitor C1 to the capacitance of the second capacitor C2 (for example, C2/C1) may be about 0.2. Therefore, the falling time of the light emission control signal E1 may be minimized without malfunction of the eighth transistor T8, and the falling step may be eliminated.

The first signal processor 330 may be connected to a fifth node N5 that electrically connects the second node N2 and the fourth node N4. The first signal processor 330 may control the voltage of the fourth node N4 based on the second clock signal CLK2 supplied to the third input terminal 103 and a voltage of the fifth node N5. For example, when the voltage of the second node N2 has a gate off level, the first signal processor 330 may cause the ninth transistor T9 to be completely turned off by causing the voltage of the fourth node N4 to stable have a gate off level.

According to some example embodiments, the first signal processor 330 may include a tenth transistor T10, an eleventh transistor T11, and a third capacitor C3.

The third capacitor C3 may be connected between the fifth node N5 and a sixth node N6.

The tenth transistor T10 may be connected between the third input terminal 103 and the sixth node N6. A gate electrode of the tenth transistor T10 may be connected to the fifth node N5. The tenth transistor T10 may be turned on or off in response to the voltage of the fifth node N5.

The eleventh transistor T11 may be connected between the sixth node N6 and the fourth node N4. A gate electrode of the eleventh transistor T11 may be connected to the third input terminal 103. The eleventh transistor T11 may be turned on in response to a gate on level of the second clock signal CLK2 supplied to the third input terminal 103. Therefore, one end of the third capacitor (that is, the sixth node N6) and the fourth node N4 may be electrically connected to each other. At this time, even though the tenth and eleventh transistors T10 and T11 are switched, the voltage of the fourth node N4 may be maintained without a large change by the third capacitor C3 charged with the voltage of the fifth node N5 (or the second node N2). For example, the voltage of the fourth node N4 may have a voltage level substantially the same as the second node N2 during a predetermined period in response to a clock signal (for example, the second clock signal CLK2) supplied to the third input terminal 103.

The second signal processor 340 may control the voltage of the fourth node N4 in response to the voltage of the third node N3. For example, when the third node N3 has a gate on voltage (or a gate on level), the second signal processor 340 may cause the ninth transistor T9 of the output unit 320 to be completely turned off by causing the voltage of the fourth node N4 to stably have a gate off level. According to some example embodiments, the second signal processor 340 may include a twelfth transistor T12 and a fourth capacitor C4.

The twelfth transistor T12 may be connected between the second power VGH and the fourth node N4. A gate electrode of the twelfth transistor T12 may be connected to the third node N3. The twelfth transistor T12 may be turned on or off in response to the voltage of the third node N3.

The fourth capacitor C4 may be connected between the second power VGH and the fourth node N4. The fourth capacitor C4 may charge a voltage applied to the fourth node N4 and stably maintain the voltage of the fourth node N4.

For example, when the eighth transistor T8 is turned on by the voltage of the first node N1 and/or the voltage of the third node N3, the twelfth transistor M12 may be turned on and thus the voltage of the second power VGH may be supplied to the fourth node N4.

The first stabilizer 350 may be electrically connected between the input unit 310 and the output unit 320. The first stabilizer 350 may limit a voltage drop between the first node N1 and the third node N3 and a voltage drop between the second node N2 and the fourth node N4. According to some example embodiments, the first stabilizer 350 may drop the voltage of the fifth node N5 to be less than the voltage of the second power VGH to limit the voltage drop between the second node N2 and the fourth node N4.

According to some example embodiments, the first stabilizer 350 may include a thirteenth transistor T13 and a fourteenth transistor T14.

The fourteenth transistor T14 may be connected between the first node N1 and the third node N3. For example, the fourteenth transistor T14 may be connected between one electrode of the second transistor T2 and the third node N3. At this time, another electrode of the second transistor T2 may be connected to the first node N1.

A gate electrode of the fourteenth transistor T14 may be connected to the first power VGL. Therefore, the fourteenth transistor T14 may always maintain a turn-on state. The fourteenth transistor T14 may prevent a line voltage drop or the like between the first node N1 and the third node N3. Therefore, the gate on voltage (logic low level) of the light emission control signal E1 may be stably output.

The thirteenth transistor T13 may be connected between the second node N2 and the fifth node N5. A gate electrode of the thirteenth transistor T13 may be connected to the first power VGL. Therefore, the thirteenth transistor T13 may always have a turn-on state. The thirteenth transistor T13 may prevent a line voltage drop or the like between the second node N2 and the fifth node N5 (to the fourth node N4).

The second stabilizer 360 may control an electrical connection between the third node N3 and the first node N1 in response to the second clock signal CLK2 supplied to the third input terminal 103. According to some example embodiments, the second stabilizer 360 may disconnect the electrical connection between the first node N1 and the third node N3 in response to the second clock signal CLK2 supplied to the third input terminal 103 and the voltage of the fourth node N4. For example, according to some example embodiments, the second stabilizer 360 may include a first transistor T1 and a second transistor T2.

The first transistor T1 may be connected between the fourth node N4 and a gate electrode of the second transistor T2. For example, a first electrode of the first transistor T1 may be connected to the fourth node N4, and a second electrode of the first transistor T1 may be connected to the gate electrode of the second transistor T2.

According to some example embodiments, the first transistor T1 may include a gate electrode connected to the third input terminal 103. The first transistor T1 may supply the voltage of the fourth node N4 to the gate electrode of the second transistor T2 in response to the second clock signal CLK2.

The second transistor T2 may be connected between the first node N1 and the third node N3. For example, the second transistor T2 may be connected between the first node N1 and the fourteenth transistor T14. The second transistor T2 may include the gate electrode connected to the second electrode of the first transistor T1. The second transistor T2 may be turned on in response to a voltage supplied from the first transistor T1.

In a period in which the light emission control signal E1 has the gate on level (logical low level) (that is, in a state in which the eighth transistor T8 is turned on), the second stabilizer 360 may disconnect the electrical connection between the first node N1 and the third node N3. That is, because the second transistor T2 is turned on based on the voltage of the fourth node N4 having the gate off level, the electrical connection between the first node N1 and the third node N3 may be disconnected. At this time, because no other signal is supplied to the third node N3, the voltage of the third node N3 is not largely changed from the gate on voltage until the third node N3 and the first node N1 are electrically connected to each other again. Therefore, the eighth transistor N8 may maintain the turn-on state.

Accordingly, in a period during which the light emission control signal E1 is output at the gate on level, the gate off level (logic high level) of the start signal EFLM (or the output signal of the previous stage) by the turn-on of the third transistor T3 may be prevented from being supplied to the third node N3 through the fourteenth transistor T14.

Therefore, in the period in which the light emission control signal E1 has the gate on level, a phenomenon in which the eighth transistor T8 is unintentionally turned off in response to the signal supplied to the first input terminal 101 may be prevented.

Thus, the stage ST1 may stably output the waveform of the light emission control signal E1 having the plurality of gate on periods and gate off periods during one frame period.

Figure 5:
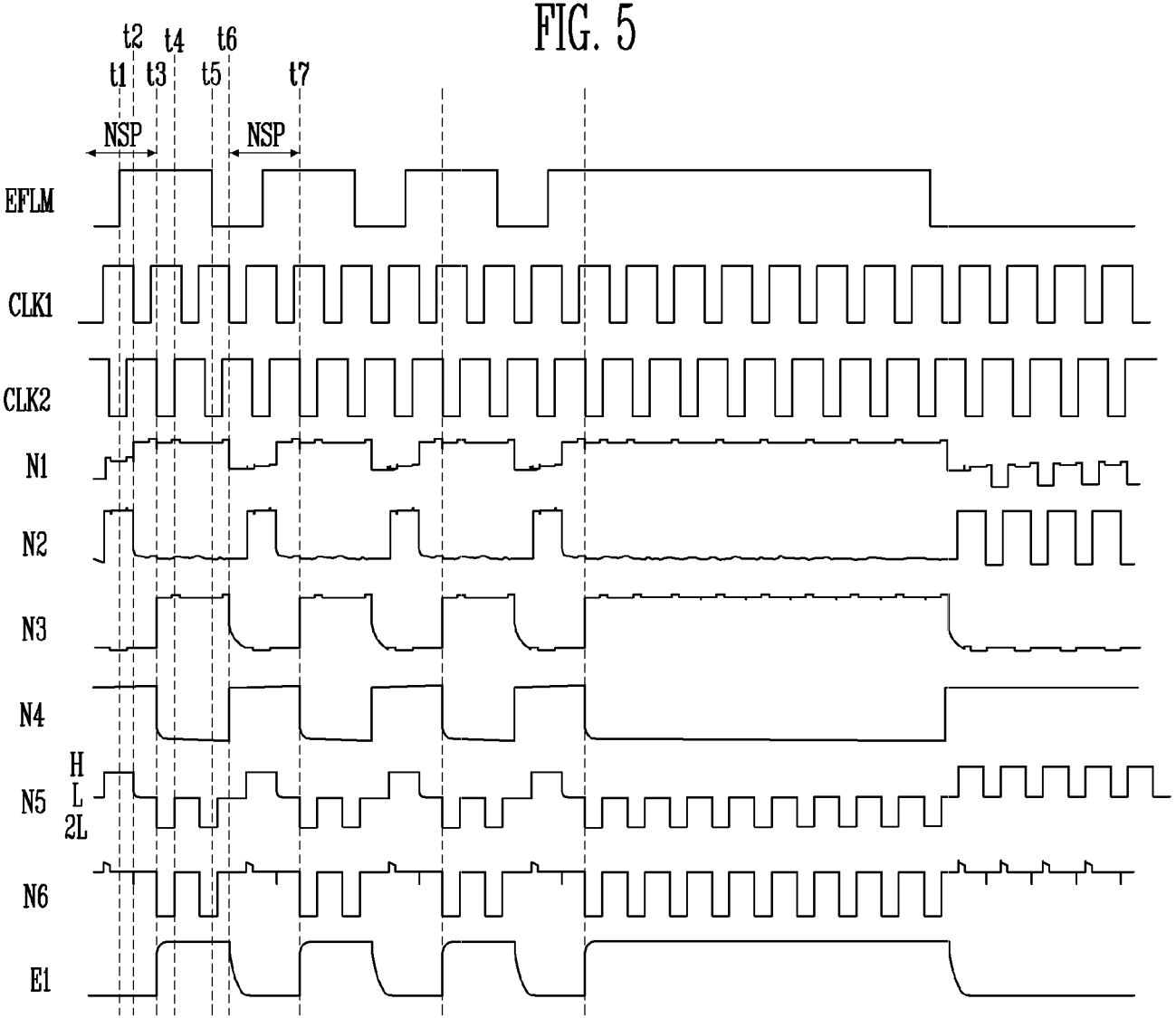
FIG. 5 is a waveform diagram illustrating an example of an operation of the stage of FIG. 4.

FIG. 5 is a waveform diagram illustrating an example of an operation of the stage of FIG. 4.

Referring to FIGS. 4 and 5, the first clock signal CLK1 and the second clock signal CLK2 are supplied at different timings. For example, the second clock signal CLK2 is set as a signal shifted by a half period (for example, one horizontal period 1H) from the first clock signal CLK1.

The gate on level (logical high level or high voltage) of the start signal EFLM may correspond to the voltage of the first power VGL, and the gate off level (logical low level or low voltage) of the start signal EFLM may correspond to the voltage of the second power VGH. According to some example embodiments, the start signal EFLM of FIG. 5 may have a waveform for output of the light emission control signal described with reference to FIG. 2B or 3B. That is, during one frame period, the start signal ELFM and the light emission control signal E1 may include the plurality of gate on periods and gate off periods.

When the clock signals CLK1 and CLK2 are supplied, the voltage of the first power VGL is supplied to each of the second input terminal 102 and the third input terminal 103, and when the clock signals CLK1 and CLK2 are not supplied, the voltage of the second power VGH may be supplied to the second input terminal 102 and the third input terminal 103.

At a first time point t1, the second clock signal CLK2 may be supplied to the third input terminal 103, and the supply of the start signal EFLM may be stopped (that is, the gate off level of the start signal EFLM may be supplied). At this time, the first transistor T1 and the eleventh transistor T11 are changed from the turn-off state to the turn-on state. Therefore, the voltages of the first to sixth nodes N1 to N6 may maintain previous states.

At the first time point t1, the second transistor T2 may be turned off by the voltage of the fourth node N4 of the gate off level (high voltage), and the electrical connection between the first node N1 and the third node N3 may be disconnected. When the electrical connection between the first node N1 and the third node N3 is disconnected, the voltage of the third node N3 may maintain the voltage level of a previous state. The voltage of the third node N3 may be finely reduced by the coupling of the second capacitor C2 by the change of the second clock signal CLK2 supplied to one end of the second capacitor C2. Therefore, the eighth transistor T8 may stably maintain the turn-on state.

The first clock signal CLK1 may be supplied to the second input terminal 102 at a second time point t2. Therefore, the third transistor T3 and the fifth transistor T5 may be turned on. At this time, the supply of the second clock signal CLK2 is stopped.

When the third transistor T3 is turned on, a voltage of a gate off level may be supplied to the first input terminal 101. However, because the second transistor T2 has the turn-off state, the voltage of the gate off level is not transferred to the third node N3. That is, a state in which the first node N1 and the third node N3 are electrically separated (or opened) is maintained. At this time, the voltage of the third node N3 may maintain the voltage level of the previous state. For example, the third node N3 may maintain the voltage level of the previous state without a large change by the first and second capacitors C1 and C2 and parasitic capacitors. Therefore, the eighth transistor T8 may maintain the turn-on state, and the light emission control signal E1 may be output at the gate on level.

When the fifth transistor T5 is turned on, a voltage of a gate on level may be transferred to the second node N2. Here, the tenth transistor T10 may be turned on by the voltage of the fifth node N5, and the second clock signal CLK2 of the gate off level may be transferred to the sixth node N6. Because the sixth node N6 has a voltage of a gate off level, the voltage of the fifth node N5 may change to a first low level L by coupling of the third capacitor C3.

Meanwhile, the voltage of the second power VGH may be supplied to the fourth node N4 by the twelfth transistor T12 of the turn-on state at the second time point t2. Then, the fourth node N4 may maintain the gate off voltage and the ninth transistor T9 may maintain the turn-off state. A voltage capable of turning off the ninth transistor T9 may be charged in the fourth capacitor C4.

In addition, at the second time point t2, because the eleventh transistor T11 is the turn-off state by the first clock signal CLK1 of the gate off level, the fourth node N4 may have the voltage of the second power VGH regardless of the voltage of the fifth node N5 and the voltage of the sixth node N6.

The second clock signal CLK2 may be supplied to the third input terminal 103 at a third time point t3. Therefore, the first transistor T1, the seventh transistor T7, and the eleventh transistor T11 may be turned on.

At this time, the first clock signal CLK1 and the start signal EFLM have a gate off level. Therefore, the third to fifth transistors T3, T4, and T5 have the turn-off state.

In addition, the gate on voltage of the second clock signal CLK2 may be supplied to the sixth node N6 by the tenth transistor T10 maintaining the turn-on state at the third time point t3. Therefore, a potential of the fifth node N5 may change to a second low level 2L by the coupling of the third capacitor C3.

Meanwhile, the sixth transistor T6 may maintain the turn-on state in response to the voltage of the second node N2 of the gate on level at the third time point t3. Therefore, the second power VGH may be supplied to the first node N1 by the seventh transistor T7 turned on in response to the second clock signal CLK2. Thus, the first node N1 may have a voltage of a gate off level.

According to some example embodiments, the voltage of the sixth node N6 may be transferred to the fourth node N4 by the turned on eleventh transistor T11, and the fourth node N4 may have a voltage of a gate on level. Therefore, the ninth transistor T9 may be turned on and thus the light emission control signal E1 may change to a gate off level. In addition, the second transistor T2 may be turned on by the voltage of the fourth node N4.

When the second transistor T2 is turned on, the voltage of the first node N1 may be transferred to the third node N3. Therefore, the third node N3 may have a voltage of a gate off level, and the eighth transistor T8 may be turned off. Therefore, the light emission control signal E1 may have a gate off level at the third time point t3.

That is, after the start signal EFLM is transited to the gate off level, the light emission control signal E1 may be transited to the gate off level in synchronization with the falling time (that is, the third time point t3) of the second clock signal CLK2.

A period in which the light emission control signal E1 of the gate on level is output (that is, a period before the third time point t3) may be defined as a node separation period NSP. Because the second transistor T2 is turned off in the node separation period NSP, the first node N1 and the third node N3 are electrically separated from each other. Therefore, the gate off level of the start signal EFLM may be prevented from being transferred to the third node N3 in the node separation period NSP. Accordingly, the voltage level of the light emission control signal E1 may be prevented from being unintentionally increased before the third time point t3.

Thereafter, the supply of the second clock signal CLK2 may be stopped at a fourth time point t4. That is, the second clock signal CLK2 of the gate on level may be transited to the gate off level. Therefore, the first transistor T1, the seventh transistor T7, and the eleventh transistor T11 may be turned off.

At this time, the second clock signal CLK2 of the gate off level is supplied to the sixth node N6 by the tenth transistor T10 of the turn-on state, and the voltage of the sixth node N6 is increased to the gate off level. The voltage of the fifth node N5 may be increased to the first low level L by the coupling of the third capacitor C3.

Thereafter, in a state in which the start signal EFLM of the gate off level is supplied, the supply of the first clock signal CLK1 and the second clock signal CLK2 is alternately repeated, and the voltage levels of the fifth and sixth nodes N5 and N6 may be changed in response thereto. However, when the voltage of the sixth node N6 has a gate off level in the period, because the first transistor T11 is turned off, the fourth node N4 may maintain the gate on level.

In addition, because the transition of the voltage level does not occur at nodes other than the voltages of the fifth and sixth nodes N5 and N6, the light emission control signal E1 maintains the gate off level.

The start signal EFLM is transited to the gate on level at a fifth time point t5. Because the first clock signal CLK1 has a gate off level at the fifth time point t5, the third transistor T3 is the turn-off state. Therefore, a waveform change of the start signal EFLM at the fifth time point t5 does not affect the operation of the stage ST1 and the output of the light emission control signal E1.

Meanwhile, at the fifth time point t5, because the fourth node N4 has a gate on level and the first transistor T1 is turned on, the second transistor T2 may be turned on.

Thereafter, the supply of the second clock signal CLK2 may be stopped before a sixth time point t6, and thus the first transistor T1 may be turned off. Therefore, an electrical connection between the gate electrode of the second transistor T2 and the first transistor T1 may be disconnected. However, due to a parasitic capacitor connected to the gate electrode of the second transistor T2, the second transistor T2 may remain the turn-on state until the voltage of the fourth node N4 by the turn-on of the first transistor T1 is subsequently applied to the gate of the second transistor T2.

In other words, the on/off state of the second transistor T2 may be determined by the voltage of the fourth node N4, and may be changed when the first transistor T1 is turned on by the second clock signal CLK2.

The first clock signal CLK1 and the start signal EFLM may be supplied at the sixth time point t6. That is, the first clock signal CLK1 may be transited from a gate off level to a gate on level, and the third transistor T3 and the fifth transistor T5 may be turned on. In addition, because the first transistor T1 has the turn-off state at the sixth time point t6, the second transistor T2 may maintain the turn-on state.

When the third transistor T3 is turned on, a voltage of a gate on level (that is, the start signal EFLM) may be supplied to the first node N1 through the first input terminal 101. Therefore, the fourth transistor T4 may be turned on and a voltage of a gate on level may be supplied to the second node N2 through the fourth and fifth transistors T4 and T5.

Because the second transistor T2 maintains the turn-on state, the first node N1 and the third node N3 may be electrically connected to each other. Therefore, a voltage of a gate on level may be supplied to the third node N3.

The twelfth transistor T12 may be turned on by the voltage of the third node N3 of the gate on level, and the voltage of the second power VGH may be supplied to the fourth node N4. The ninth transistor T9 may be turned off in response to the voltage of the fourth node N4.

In addition, the eighth transistor T8 may be turned on in response to the voltage of the third node N3 of the gate on level at the sixth time point t6. When the eighth transistor T8 is turned on, the voltage of the second power VGL is supplied to the output terminal 104. When the voltage of the second power VGL is supplied to the output terminal 104, the light emission control signal E1 may be output at a gate off level.

That is, after the start signal EFLM transited to the gate on level, the light emission control signal E1 may be transited to the gate on level in synchronization with a falling time of the first clock signal CLK1 (that is, the sixth time point t6).

On the other hand, when the light emission control signal E1 changes to a gate off level, the voltage of the third node N3 may be reduced with a width greater than that of the voltage of the first node N1 due to the coupling (or boosting) of the first capacitor C1. Therefore, the light emission control signal E1 may be quickly transited from the gate off level to the gate on level, and the falling time of the light emission control signal E1 may be shortened. Thus, a period between time points of falling and rising again of the light emission control signal E1 may be sufficiently secured, and thus reliability of pixel driving as shown in FIG. 2B in the high speed driving method may be improved.

Meanwhile, the ratio of the second capacitor C2 and the first capacitor C1 may be determined in consideration of both of the falling time of the light emission control signal E1 and the characteristic deviation of the transistor (for example, the eighth transistor T8). Therefore, the falling time of the light emission control signal E1 may be minimized without malfunction of the eighth transistor T8, and the falling step may be eliminated or minimized.

Thereafter, when the second clock signal CLK2 is supplied, the first transistor T1 may be turned on. When the voltage of the gate off level of the fourth node N4 is supplied to the gate electrode of the second transistor T2 by the turn-on of the first transistor T1, the second transistor T2 may be turned off. Therefore, the electrical connection between the first node N1 and the third node N3 may be disconnected. Thus, a voltage of a sufficiently low gate on level may be supplied to the gate electrode of the eighth transistor T8 by the voltage stored in the first capacitor C1 and the second capacitor C2, and the light emission control signal E1 may be stably supplied.

Meanwhile, an electrical open state between the first node N1 and the third node N3 may be maintained by the turn-off of the second transistor T2 until a time point (a seventh time point t7) when the voltage of the fourth node N4 changes to the gate on level by the supply of the second clock signal CLK2. That is, a period from the sixth time point t6 at which the light emission control signal E1 is output to the seventh time point t7 may be the node separation period NSP.

Thereafter, when the start signal EFLM changes to a gate off level, the operations of the first time points t1 to the sixth time point t6 may be repeated.

Figure 6:
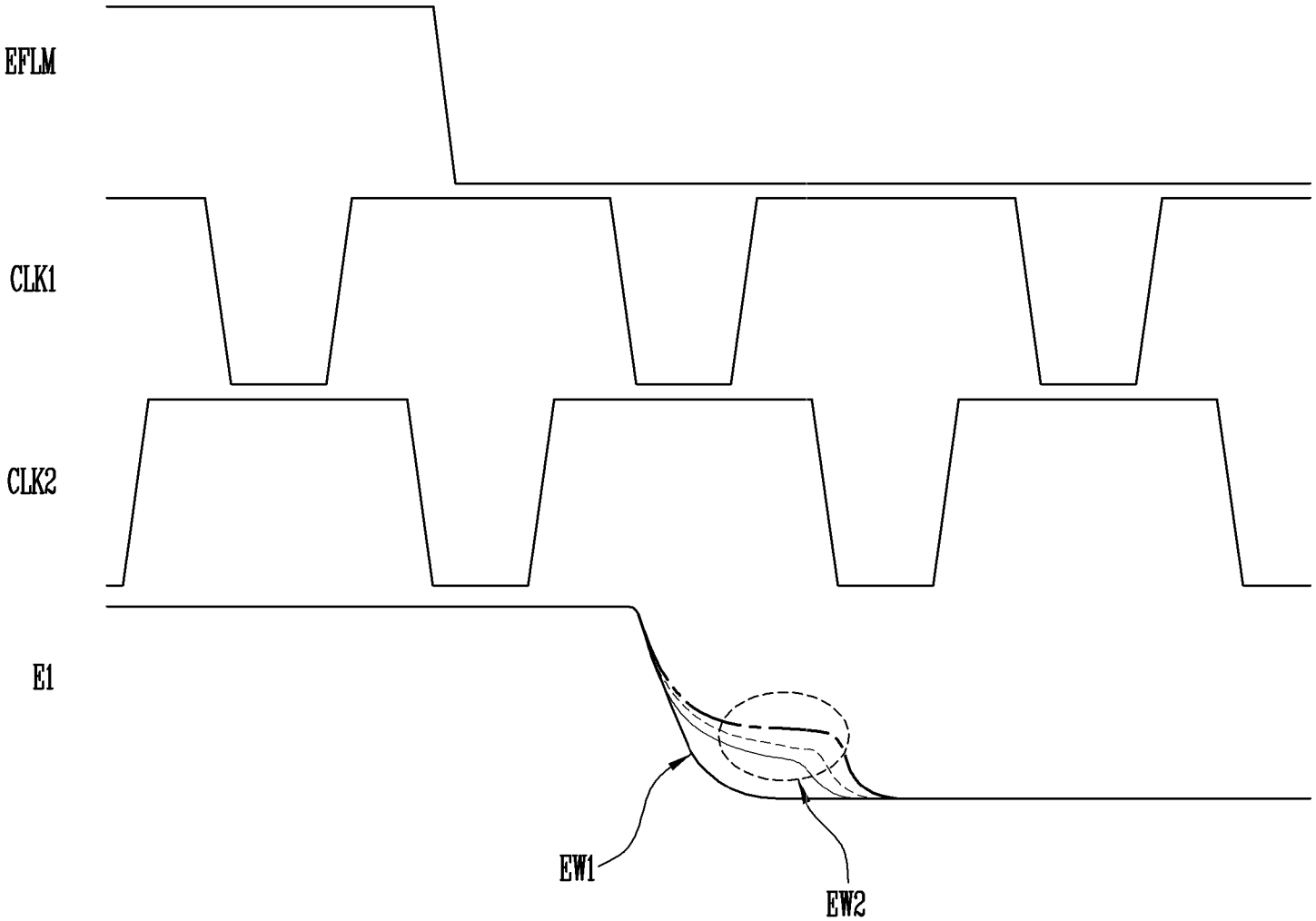
FIG. 6 is an enlarged waveform diagram of a portion of the waveform diagram of FIG. 5.

FIG. 6 is an enlarged waveform diagram of a portion of the waveform diagram of FIG. 4.

Referring to FIGS. 4 to 6, the falling time of the light emission control signal may be reduced.

After the start signal EFLM is changed from the gate off level (for example, high voltage) to the gate on level (for example, low voltage), the light emission control signal E1 may be fallen in response to the gate on level of the first clock signal CLK1. According to some example embodiments, the falling time (or falling rate) of the light emission control signal E1 may be controlled according to the capacitance ratio of the first capacitor C1 and the second capacitor C2.

For example, when the second capacitor C2 is not present or the capacitance of the second capacitor C2 is very small compared to the capacitance of the first capacitor C1, the light emission control signal E1 may quickly fall without a falling step (indicated by EW1 in FIG. 6). As the capacitance of the second capacitor C2 increases, the falling time of the light emission control signal E1 increases (indicated by EW2 in FIG. 6), and a slew rate may decrease.

However, in order to set the margin in consideration of the deviation on the manufacturing process and the characteristic change due to the deterioration of the transistors (for example, the eighth transistor T8), the ratio of the first capacitor C1 and the second capacitor C2 may be controlled.

Figure 7A:
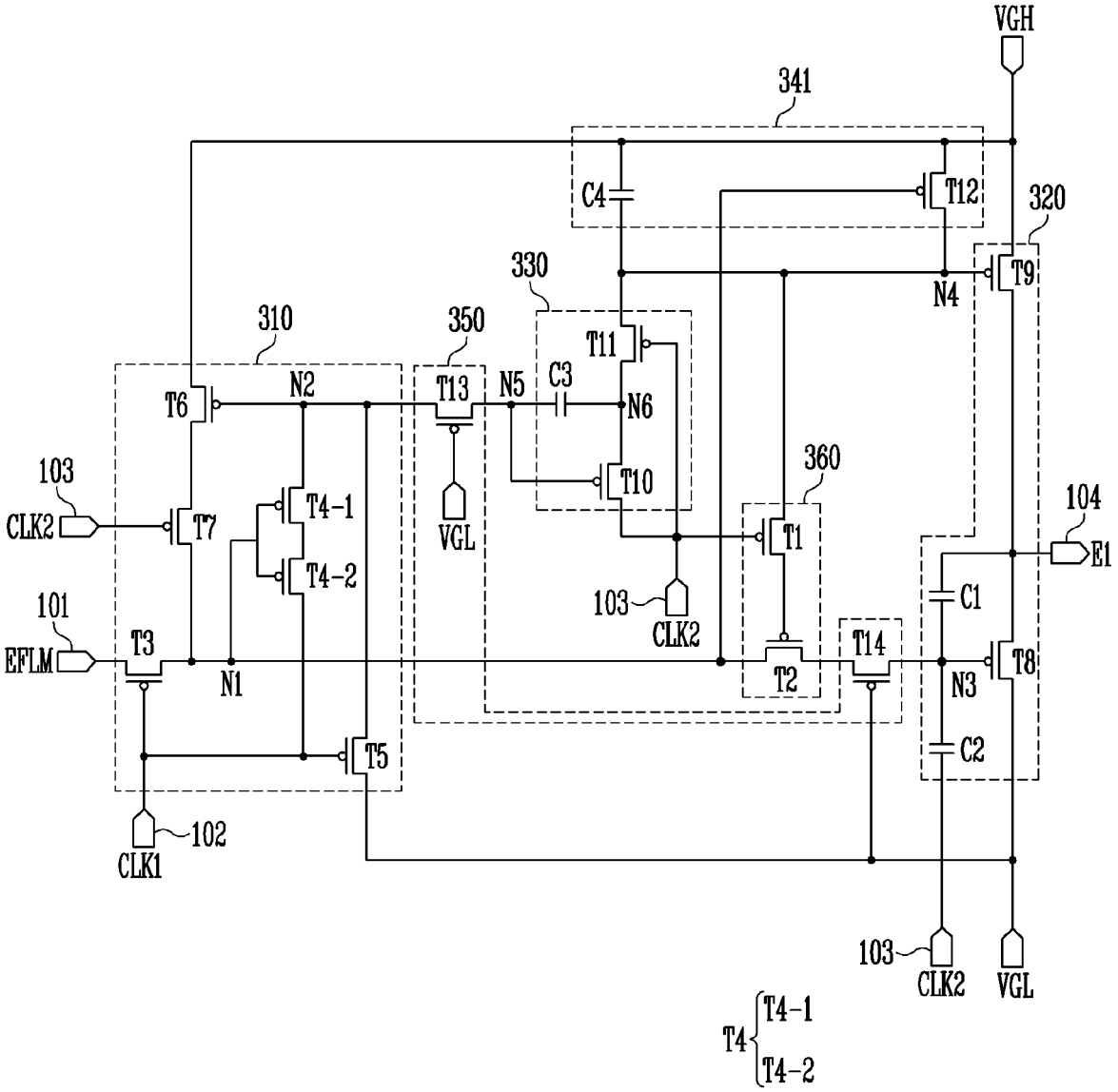
FIGS. 7A and 7B are circuit diagrams illustrating an example of the stage included in the light emission driver of FIG. 2.
Figure 7B:
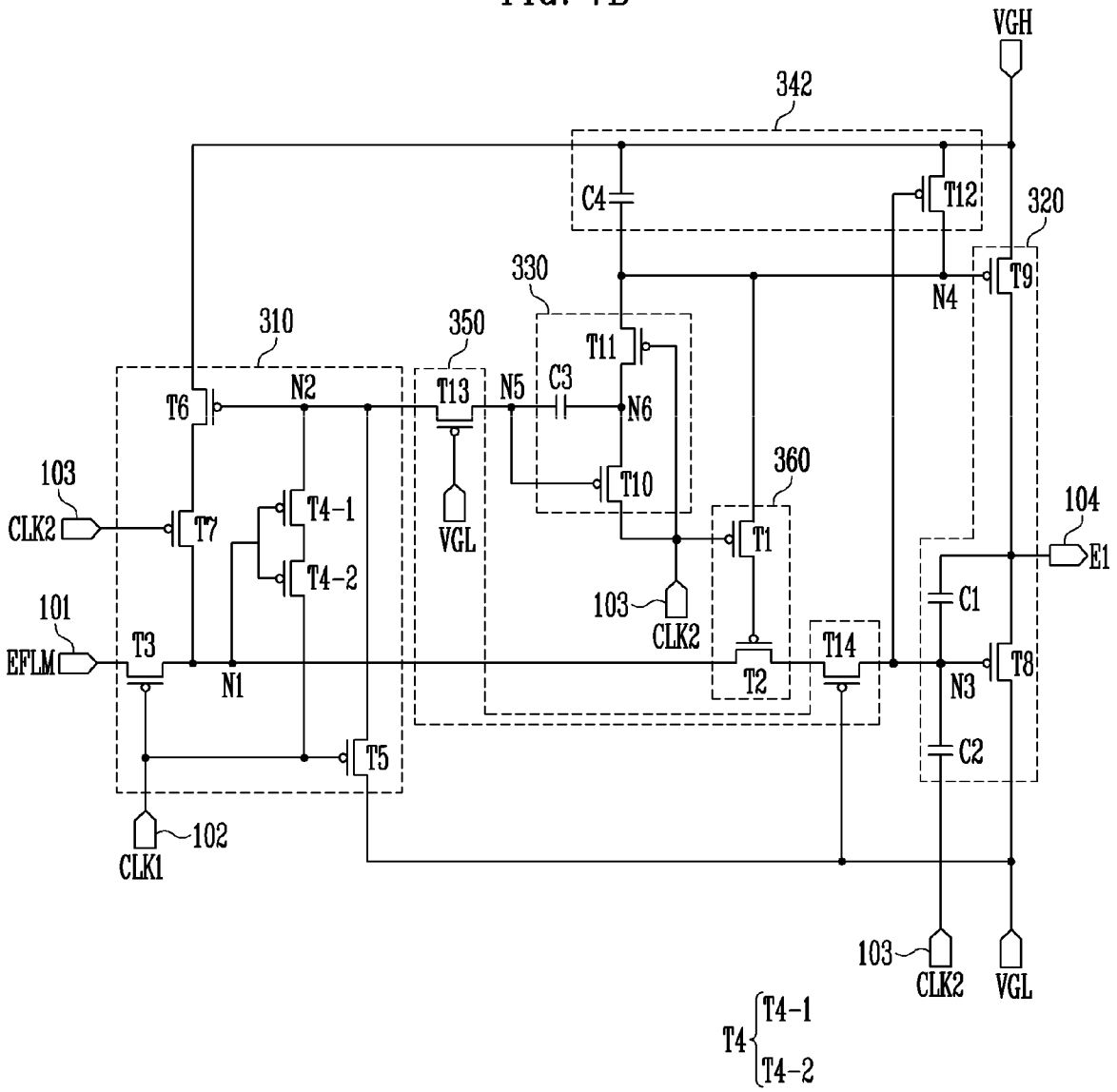

FIGS. 7A and 7B are circuit diagrams illustrating an example of the stage included in the light emission driver of FIG. 2.

In FIGS. 7A and 7B, the same reference numerals are used for the components described with reference to FIG. 4, and repetitive descriptions of such components will be omitted. In addition, the stage of FIGS. 7A and 7B may have a configuration substantially the same as or similar to that of the stage of FIG. 4 except for a configuration of a twelfth transistor of a second signal processor.

Referring to FIGS. 7A and 7B, the first stage may include the input unit 310, the output unit 320, the first signal processor 330, a second signal processor 341 and 342, the first stabilizer 350, and the second stabilizer 360.

The second signal processors 341 and 342 may supply the voltage of the second power VGH to the fourth node N4 in response to the voltage of the third node N3. The second signal processor 341 and 342 may include a fourth capacitor C4 and a twelfth transistor T12.

According to some example embodiments, as shown in FIG. 7A, a gate electrode of the twelfth transistor T12 may be connected between the third transistor T3 and the second transistor T2. According to some example embodiments, as shown in FIG. 7B, the gate electrode of the twelfth transistor T12 may be connected between the fourteenth transistor T14 and the gate electrode of the eighth transistor T8.

The stages of FIGS. 7A and 7B may perform substantially the same operations as the stage of FIG. 4. Therefore, a circuit configuration of FIGS. 4, 7A, and 7B may be selectively applied according to a design condition and a layout of the light emission driver and the display device including the same.

Figure 8:
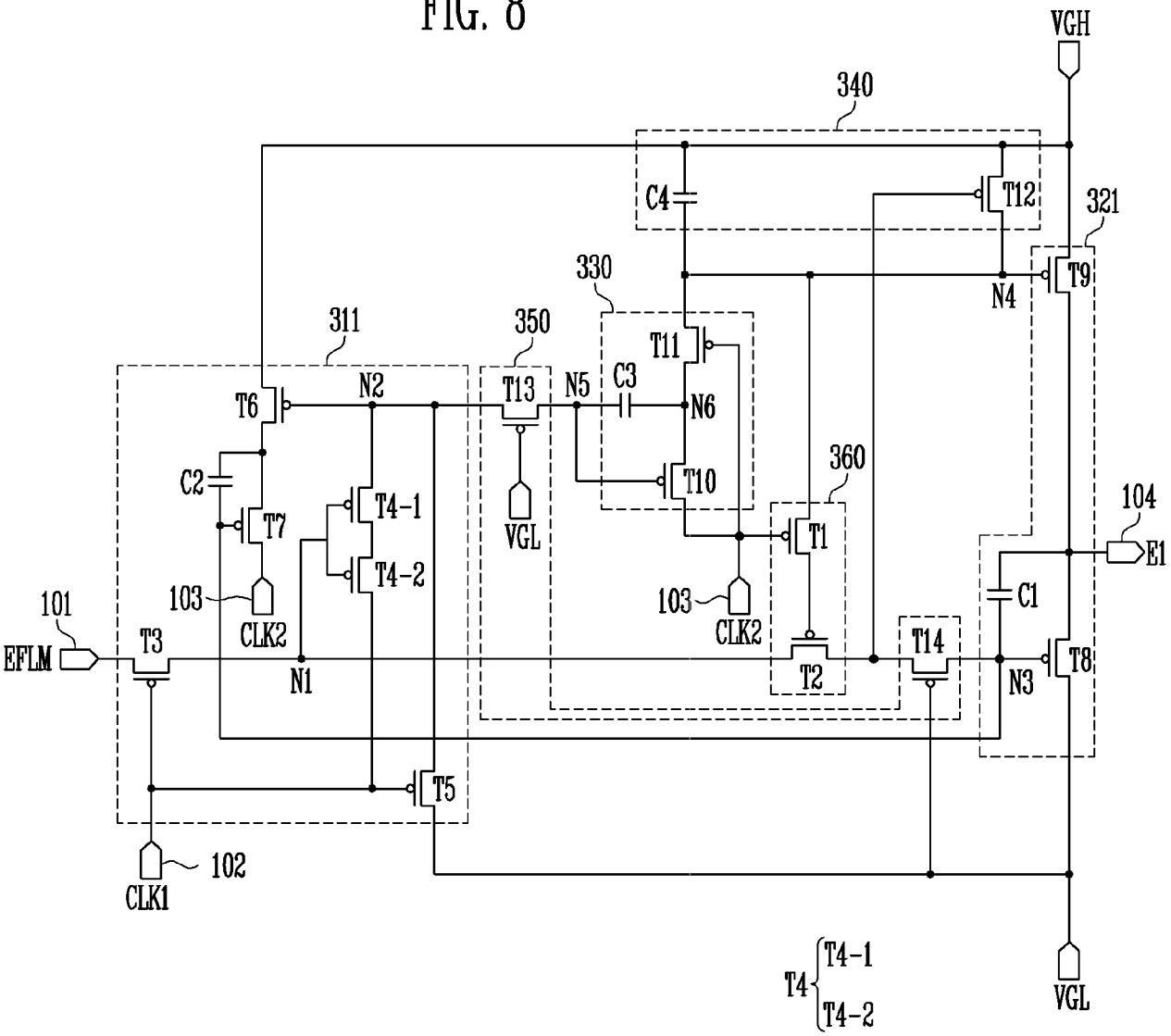
FIG. 8 is a circuit diagram illustrating an example of the stage included in the light emission driver of FIG. 2.
Figure 9:
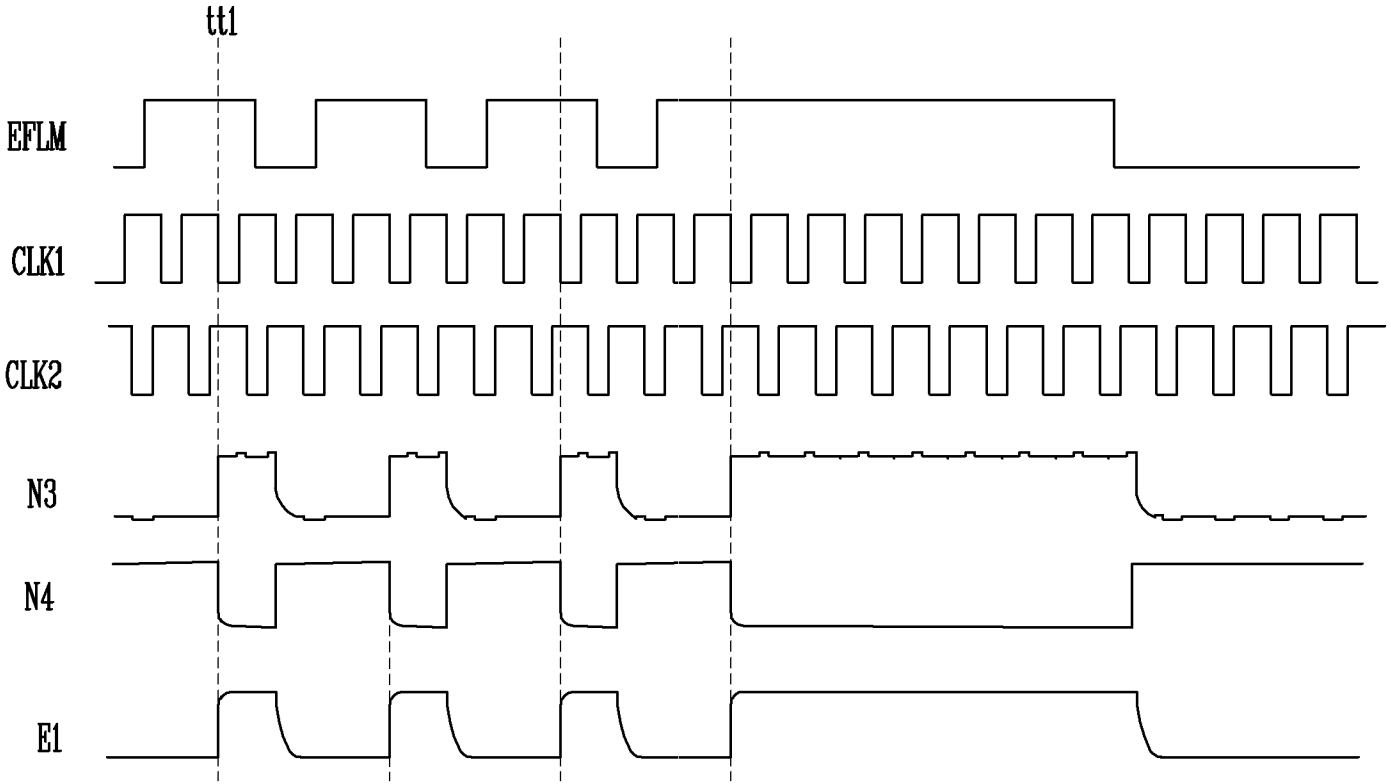
FIG. 9 is a waveform diagram illustrating an example of an operation of the stage of FIG. 8.

FIG. 8 is a circuit diagram illustrating an example of the stage included in the light emission driver of FIG. 2, and FIG. 9 is a waveform diagram illustrating an example of an operation of the stage of FIG. 8.

In FIGS. 8 and 9, the same reference numerals are used for the components described with reference to FIGS. 4 and 5, and repetitive descriptions of such components will be omitted. In addition, the stage of FIG. 8 may have a configuration substantially the same as or similar to that of the stage of FIG. 4 except for a configuration of a seventh transistor and a second capacitor.

Referring to FIGS. 8 and 9, the first stage may include an input unit 311, an output unit 321, the first signal processor 330, the second signal processor 341 and 342, the first stabilizer 350, and the second stabilizer 360.

The input unit 311 may control the voltages of the second node N2 and the third node N3 in response to the signals (for example, the start signal EFLM, the first clock signal CLK1 and the second clock signal CLK2) supplied to the first input terminal 101, the second input terminal 102, and the third input terminal 103. According to some example embodiments, the input unit 311 may include third to seventh transistors T3 to T7.

The sixth transistor T6 and the seventh transistor T7 may be connected in series with each other between the second power VGH and the third input terminal 103. The sixth transistor T6 may include a gate electrode connected to the second node N2. The sixth transistor T6 may be turned on or off in response to the voltage of the second node N2. The seventh transistor T7 may include a gate electrode connected to the third node N3. The seventh transistor T7 may be turned on in response to the voltage of the third node N3.

The input unit 311 may further include a second capacitor C2. One electrode of the second capacitor C2 may be connected between the sixth transistor T6 and the seventh transistor T7, and the other electrode of the second capacitor C2 may be connected to the third node N3.

When the third node N3 has a gate on level and the second node N2 has a gate off level, a connection relationship between the first capacitor C1 and the second capacitor C2 is substantially the same as a connection relationship between the first capacitor C1 and the second capacitor C2 of FIGS. 4, 7A, and 7B. Therefore, the falling time and the slew rate of the light emission control signal E1 may be controlled according to the capacitance ratio of the first capacitor C1 and the second capacitor C2.

Meanwhile, after the start signal EFLM of the gate off level is supplied, when the first clock signal CLK1 is supplied, the gate on level is supplied to the second node N2.

Thereafter, at a time when the first clock signal CLK1 is supplied again (that is, shown as ttl in FIG. 9), the start signal EFLM of the gate off level may be supplied to the first and third nodes N1 and N3 by the turn-on of the third transistor T3. The light emission control signal E1 of FIG. 9 may be output about half a period later than the light emission control signal E1 of FIG. 5. Therefore, the gate off period of the light emission control signal E1 may be shortened. However, because the gate off period of the light emission control signal E1 has a long time of 3 horizontal periods 3H or more, such a reduction of the gate off period does not adversely affect the pixel driving.

As described above, the stage circuit configuration for performing high speed driving may be variously designed.

As described above, the light emission driver and the display device including the same according to the embodiments of the disclosure includes the stage having the second stabilizer 360 that disconnects the electrical connection between the first node N1 and the third node N3 during the gate on period of the light emission control signal E1. Therefore, an unintentional increase (the turn-off of the eighth transistor T8, or an increase of the gate voltage of the eighth transistor T8) of the voltage level of the light emission control signal E1 may be prevented in the gate on period of the light emission control signal E1.

In addition, the stage included in the light emission driver includes the first and second capacitors C1 and C2. Therefore, the falling time of the light emission control signal E1 may be shortened without malfunction of the eighth transistor T8, and the falling step may be eliminated. Therefore, the driving reliability in the high speed driving method of the display device may be improved.

Although the disclosure has been described with reference to the embodiments of the disclosure, those skilled in the art may understand that the disclosure may be variously modified and changed without departing from the spirit and scope of the disclosure as set forth in the claims below, and their equivalents.

What is claimed is:

1. A light emission driver comprising:

a plurality of stages configured to output a light emission control signal, wherein each of the stages comprises:

an input circuit comprising a first input terminal, a second input terminal, and a third input terminal, wherein the input circuit is configured to control voltages of a first node and a second node in response to first and second clock signals;

an output circuit configured to supply a voltage of a first power or a voltage of a second power to an output terminal in response to a voltage of a third node and a voltage of a fourth node;

a first signal processor connected to a fifth node electrically connecting the second node and the fourth node to each other, and configured to control the voltage of the fourth node based on the second clock signal supplied to the third input terminal and a voltage of the fifth node;

a second signal processor configured to control the voltage of the fourth node in response to the voltage of the third node;

a first stabilizer electrically connected between the input circuit and the output circuit, and configured to limit a voltage drop of the first node and the second node; and a second stabilizer configured to control an electrical connection between the third node and the first node in response to the voltage of the fourth node and the second clock signal supplied to the third input terminal, wherein the second stabilizer comprises a first transistor having a first electrode connected to the fourth node and a gate electrode connected to the third input terminal and a second transistor connected between the first node and the third node and having a gate electrode connected to a second electrode of the first transistor, wherein the second stabilizer is configured to disconnect the electrical connection between the first node and the third node in response to the second clock signal supplied to the third input terminal and the voltage of the fourth node, in a period in which the light emission control signal has a gate on level, and wherein the electrical connection between the first node and the third node is disconnected as the second transistor is turned off by the voltage of the fourth node of the gate off level.

2. The light emission driver according to claim 1, wherein the input circuit comprises:

a third transistor connected between the first input terminal and the first node and having a gate electrode connected to the second input terminal;

a fourth transistor connected between the second input terminal and the second node and having a gate electrode connected to the first node;

a fifth transistor connected between the first power and the second node and having a gate electrode connected to the second input terminal; and a sixth transistor and a seventh transistor connected in series with each other between the second power and the first node, wherein a gate electrode of the sixth transistor is connected to the second node, and a gate electrode of the seventh transistor is connected to the third input terminal.

3. The light emission driver according to claim 2, wherein the fourth transistor comprises a plurality of sub-transistors connected in series with each other, and each of the sub-transistors includes a gate electrode commonly connected to the first node.

4. The light emission driver according to claim 1, wherein the output circuit comprises:

an eighth transistor connected between the first power and the output terminal and having a gate electrode connected to the third node;

a ninth transistor connected between the second power and the output terminal and having a gate electrode connected to the fourth node; and a first capacitor connected between the output terminal and the third node.

5. The light emission driver according to claim 4, wherein the third node is configured to maintain a voltage of a gate on level when the second transistor is turned off in a turn-on state of the eighth transistor.

6. The light emission driver according to claim 4, wherein the output circuit further comprises:

a second capacitor connected between the third node and the third input terminal.

7. The light emission driver according to claim 6, wherein a capacitance of the first capacitor is at least twice a capacitance of the second capacitor.

8. The light emission driver according to claim 1, wherein the first signal processor comprises:

a tenth transistor connected between the third input terminal and a sixth node and having a gate electrode connected to the sixth node;

an eleventh transistor connected between the sixth node and the fourth node and having a gate electrode connected to the third input terminal; and a third capacitor connected between the fifth node and the sixth node.

9. The light emission driver according to claim 1, wherein the second signal processor comprises:

a twelfth transistor connected between the second power and the fourth node and having a gate electrode electrically connected to the third node; and a fourth capacitor connected between the second power and the fourth node.

10. The light emission driver according to claim 1, wherein the first stabilizer comprises:

a thirteenth transistor connected between the second node and the fifth node and having a gate electrode configured to receive the voltage of the first power; and a fourteenth transistor connected between the second transistor and the third node and having a gate electrode configured to receive the voltage of the first power.

11. The light emission driver according to claim 1, wherein the input circuit comprises:

a third transistor connected between the first input terminal and the first node and having a gate electrode connected to the second input terminal;

a fourth transistor connected between the second input terminal and the second node and having a gate electrode connected to the first node;

a fifth transistor connected between the first power and the second node and having a gate electrode connected to the second input terminal; and a sixth transistor and a seventh transistor connected in series with each other between the second power and the third input terminal, wherein a gate electrode of the sixth transistor is connected to the second node, and a gate electrode of the seventh transistor is connected to the third node.

12. The light emission driver according to claim 1, wherein the output circuit is configured to output the light emission control signal having at least two gate off periods during one frame.

13. The light emission driver according to claim 1, wherein the first input terminal is configured to receive a start pulse or an output signal of a previous stage.

14. The light emission driver according to claim 1, wherein the second input terminal is configured to receive a first clock signal, the third input terminal is configured to receive a second clock signal, the first clock signal and the second clock signal have a same period, and the second clock signal is a signal shifted by a half period from the first clock signal.

15. A display device comprising:

a display panel including a plurality of pixels;

a scan driver configured to supply a scan signal to the pixels through scan lines;

a data driver configured to supply a data signal to the pixels through data lines; and a light emission driver including a plurality of stages configured to supply a light emission control signal to the pixels through light emission control lines, wherein each of the stages comprises:

an input circuit comprising a first input terminal, a second input terminal, and a third input terminal, wherein the input circuit is configured to control voltages of a first node and a second node in response to first and second clock signals;

an output circuit configured to supply a voltage of a first power or a voltage of a second power to an output terminal in response to a voltage of a third node and a voltage of a fourth node;

a first signal processor connected to a fifth node electrically connecting the second node and the fourth node to each other and configured to control the voltage of the fourth node based on the second clock signal supplied to the third input terminal and a voltage of the fifth node;

a second signal processor configured to control the voltage of the fourth node in response to the voltage of the third node;

a stabilizer electrically connected between the input circuit and the output circuit and configured to limit a voltage drop of the first node and the second node; and a second stabilizer configured to control an electrical connection between the third node and the first node in response to the second clock signal supplied to the third input terminal, wherein the second stabilizer comprises a first transistor having a first electrode connected to the fourth node and a gate electrode connected to the third input terminal and a second transistor connected between the first node and the third node and having a gate electrode connected to a second electrode of the first transistor, wherein the second stabilizer is configured to disconnect the electrical connection between the first node and the third node in response to the second clock signal supplied to the third input terminal and the voltage of the fourth node while the light emission control signal is output, and wherein the electrical connection between the first node and the third node is disconnected as the second transistor is turned off by the voltage of the fourth node of the gate off level.

16. The display device according to claim 15, wherein the output circuit comprises:

a third transistor connected between the first power and the output terminal and having a gate electrode connected to the third node;

a fourth transistor connected between the second power and the output terminal and having a gate electrode connected to the fourth node;

a first capacitor connected between the output terminal and the third node; and a second capacitor connected between the output terminal and the third input terminal.

* * * * *